US006349764B1

(12) United States Patent
Adams et al.

(10) Patent No.: US 6,349,764 B1
(45) **Date of Patent: *Feb. 26, 2002**

(54) DRILLING RIG, PIPE AND SUPPORT APPARATUS

(75) Inventors: Burt A. Adams; William C. Shafer, both of Berwick; Norman A. Henry, Mandeville, all of LA (US)

(73) Assignee: Oil & Gas Rental Services, Inc., Amelia, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/586,232

(22) Filed: Jun. 2, 2000

(51) Int. Cl.[7] ..... E21B 19/06; E21B 19/07; E21B 19/16; E21B 19/18; E21B 33/035

(52) U.S. Cl. ..... 166/77.53; 166/368; 166/380; 166/382; 166/721; 166/85.1; 175/203

(58) Field of Search ..... 166/368, 367, 166/379, 378, 380, 382, 77.1, 77.4, 77.52, 77.53, 85.1, 85.5, 75.14; 175/5, 7, 85, 162, 203

(56) References Cited

U.S. PATENT DOCUMENTS

| | | | | | |
|---|---|---|---|---|---|
| 3,094,852 | A | | 6/1963 | Taylor | |
| 3,096,075 | A | * | 7/1963 | Brown | 254/29 R |
| 3,629,927 | A | * | 12/1971 | Palmer et al. | 29/240 |
| 4,791,997 | A | * | 12/1988 | Krasnov | 175/57 |
| 4,887,673 | A | * | 12/1989 | Skoruppa | 166/382 |
| 5,351,767 | A | * | 10/1994 | Stogner et al. | 175/162 |
| 5,732,909 | A | * | 3/1998 | Sonnier | 248/49 |
| 5,992,801 | A | * | 11/1999 | Torres | 248/49 |
| 6,047,781 | A | | 4/2000 | Scott et al. | |
| 6,089,338 | A | * | 7/2000 | Bouligny, Jr. | 175/423 |

OTHER PUBLICATIONS

Bourgoyne, Jr. et al., Applied Drilling Engineering 1991, Society of Petroleum Engineers, vol. 2, p. 19.*

S. T. Horton, "Drill String and Drill Collars," Rotary Drilling Series of Instructional Texts, Unit I, Lesson 3,, First Edition, 1995 (more than 4 years earlier than effective filing date of captioned application), pp. 0–105 (entire book) published by Petroleum Extension Service, Division of Continuing Education, The University of Texas at Austin, in cooperation with International Association of Drilling Contractors.

L. D. Davis, "Rotary, Kelly, Swivel, Tongs, And Top Drive," Rotary Drilling Series of Instructional Texts, Unit I, Lesson 4, First Edition, 1995 (more than 4 years earlier than effective filing date of captioned application, pp. 27–39 and 48–62 published by Petroleum Extension Service, Division of Continuing Education, The University of Texas at Austin, in cooperations with International Association of Drilling Contractors.

L.D. Davis, "The Blocks and Drilling Line," Rotary Drilling Series of Instructional Texts, Unit I, Lesson 5, Third Edition, 1996 (more than 3 years earlier than effective filing date of captioned application), pp. 1–2 and 89–92, published by Petroleum Extension Service, Division of Continuing Education, The University of Texas at Austin, in cooperation with International Association of Drilling Contractors.

Tom H. Hill, letter (2 pages) to Mr. Burt Adams dated Aug. 20, 2001, with 4 pages of attached drawings.

* cited by examiner

*Primary Examiner*—David Bagnell
*Assistant Examiner*—Jennifer H Gay
(74) *Attorney, Agent, or Firm*—Garvey, Smith, Nehrbass & Doody, L.L.C.

(57) ABSTRACT

A drill pipe for oil and gas drilling rigs, the drill pipe having an enlarged diameter section positioned between the ends of the drill pipe. The enlarged diameter section of drill pipe has a shoulder which corresponds with and is engaged by a shoulder located on wedge members of a holder in a drilling rig for supporting the drill pipe without crushing or otherwise damaging the drill pipe.

39 Claims, 14 Drawing Sheets

DRILLING RIG, PIPE AND SUPPORT APPARATUS

CROSS-REFERENCE TO RELATED APPLICATIONS

The present application pertains to subject matter that is related to two copending patent applications filed by applicants on Jun. 2, 2000: U.S. Ser. No. 09/586,233 and 09/586,239.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF INVENTION

1. Field of the Invention

The present invention relates to a drill pipe and drill pipe holder used in the oil and gas well drilling industry. More particularly, the present invention relates to a drill pipe holder that holds a joint of drill pipe in a landing string during the addition or removal of a joint of drill pipe to or from the landing string, wherein the holder and the joint of drill pipe held by the holder are configured to. support the load of the landing string with correspondingly shaped shoulders that engage when the holder holds the joint of drill pipe.

2. General Background of the Invention

Oil and gas well drilling and production operations involve the use of generally cylindrical tubes commonly known in the industry as "casing" which line the generally cylindrical wall of the borehole which has been drilled in the earth. Casing is typically comprised of steel pipe in lengths of approximately 40 feet, each such length being commonly referred to as a "joint" of casing. In use, joints of casing are attached end-to-end to create a continuous conduit. In a completed well, the casing generally extends the entire length of the borehole and conducts oil and gas from the producing formation to the top of the borehole, where one or more blowout preventors may be located on the sea floor.

Casing is generally installed or "run" into the borehole in phases as the borehole is being drilled. The casing in the uppermost portion of the borehole, commonly referred to as "surface casing," may be several hundred to several thousand feet in length, depending upon numerous factors including the nature of the earthen formation being drilled and the desired final depth of the borehole.

After the surface casing is cemented into position in the borehole, further drilling operations are conducted through the interior of surface casing as the borehole is drilled deeper and deeper. When the borehole reaches a certain depth below the level of the surface casing, depending again on a number of factors such as the nature of the formation and the desired final depth of the borehole, drilling operations are temporarily halted so that the next phase of casing installation, commonly known as intermediate casing, may take place.

Intermediate casing, which may be thousands of feet in total length, is typically made of "joints" of steel pipe, each joint typically being in the range of about 38 to 42 feet in length. The joints of intermediate casing are attached end-to-end, typically through the use of threaded male and female connectors located at the respective ends of each joint of casing.

In the process of installing the intermediate casing, joints of intermediate casing are lowered longitudinally through the floor of the drilling rig. The length of the column of intermediate casing grows as successive joints of casing are added, generally one at a time, by drill hands and/or automated handling equipment located on the floor of the drilling rig.

When the last intermediate casing joint has been added, the entire column of intermediate casing, commonly referred to as the intermediate "casing string", must be lowered further into its proper place in the borehole. The task of lowering the casing string into its final position in the borehole is accomplished by adding joints of drill pipe to the top of the casing string. The additional joints of drill pipe are added, end-to-end, by personnel and/or automated handling equipment located on the drilling rig, thereby creating a column of drill pipe known as the "landing string." With the addition of each successive joint of drill pipe to the landing string, the casing string is lowered further and further.

During this process as practiced in the prior art, when an additional joint of drill pipe is being added to the landing string, the landing string and casing string hang from the floor of the drilling rig, suspended there by a holder or gripping device commonly referred to in the prior art as "slips." When in use, the slips generally surround an opening in the rig floor through which the upper end of the uppermost joint of drill pipe protrudes, holding it there a few feet above the surface of the rig floor so that rig personnel and/or automated handling equipment can attach the next joint(s) of drill pipe.

The inner surface of the prior art slips has teeth-like grippers and is curved such that it corresponds with the outer surface of the drill pipe. The outer surface of prior art slips is tapered such that it corresponds with the tapered inner or "bowl" face of the master bushing in which the slips sit.

When in use, the inside surface of the prior art slips is pressed against and "grips" the outer surface of the drill pipe which is surrounded by the slips. The tapered outer surface of the slips, in combination with the corresponding tapered inner face of the master bushing in which the slips sit, cause the slips to tighten around the gripped drill pipe such that the greater the load being carried by that gripped drill pipe, the greater the gripping force of the slips being applied around that gripped drill pipe. Accordingly, the weight of the casing string, and the weight of the landing string being used to "run" or "land" the casing string into the borehole, affects the gripping force being applied by the slips, i.e., the greater the weight the greater the gripping force and crushing effect.

As the world's supply of easy-to-reach oil and gas formations is being depleted, a significant amount of oil and gas exploration has shifted to more challenging and difficult-to-reach locations such as deep-water drilling sites located in thousands of feet of water. In some of the deepest undersea wells drilled to date, wells may be drilled from a rig situated on the ocean surface some 5,000 to 10,000 feet above the sea floor, and such wells may be drilled some 15,000 to 20,000 feet below the sea floor. It is envisioned that as time goes on, oil and gas exploration will involve the drilling of even deeper holes in even deeper water.

For many reasons, including the nature of the geological formations in which unusually deep drilling takes place and is expected to take place in the future, the casing strings required for such wells must be unusually long and must have unusually thick walls, which means that such casing strings are unusually heavy and can be expected in the future to be even heavier. Moreover, the landing string needed to land the casing strings in such extremely deep wells must be unusually long and strong, hence unusually heavy in comparison to landing strings required in more typical wells.

For example, a typical well drilled in an offshore location today may be located in about 300 to 2000 feet of water, and may be drilled 15,000 to 20,000 feet into the sea floor. Typical casing for such a typical well may involve landing a casing string between 15,000 to 20,000 feet in length, weighing 40 to 60 pounds per linear foot, resulting in a typical casing string having a total weight of between 600,000 to 1,200,000 pounds. The landing string required to land such a typical casing string may be 300 to 2000 feet long which, at about 35 pounds per linear foot of landing string, results in a total landing string weight of 10,500 to 70,000 pounds. Hence, prior art slips in typical wells have typically supported combined landing string and casing string weight in the range of between about 610,500 to 1,270,000 pounds.

By way of contrast, extremely deep undersea wells located in 5,000 to 10,000 feet of water, uncommon today but expected to be more common in the future, may involve landing a casing string 15,000 to 20,000 feet in length, weighing 40 to 80 pounds per linear foot, resulting in a total casing string weight of 600,000 to 1,600,000 pounds. The landing string required to land such casing strings in such extremely deep wells may be 5,000 to 10,000 feet long which, at 70 pounds per linear foot, results in a total landing string weight of about 350,000 to 700,000 pounds. Hence, the combined landing string and casing string weight for extremely deep undersea wells may be in the range of 950,000 to 2,300,000 pounds, instead of the 610,500 to 1,270,000 pound range generally applicable to more typical wells. In the future, as deeper wells are drilled in deeper water, the combined landing string and casing string weight can be expected to increase, perhaps up to as much as 4,000,000 pounds or more.

Under certain circumstances, prior art slips have been able to support the combined landing string and casing string weight of 610,500 to 1,270,000 pounds associated with typical wells, depending upon the size, weight and grade of the pipe being held by the slips. In contrast, prior art slips cannot effectively and consistently support the combined landing string and casing string weight of 950,000 to 2,300,000 pounds associated with extremely deep wells, because of numerous problems which occur at such extremely heavy weights.

For example, prior art slips used to support combined landing string and casing string weight above the range of about 610,500 to 1,270,000 pounds have been known to apply such tremendous gripping force that (a) the gripped pipe has been crushed or otherwise deformed and thereby rendered defective, (b) the gripped pipe has been excessively scored and thereby damaged due to the teeth-like grippers on the inside surface of the prior art slips being pressed too deeply into the gripped drill pipe and/or (c) the prior art slips have experienced damage rendering them inoperable.

A related problem involves the uneven distribution of force applied by the prior art slips to the gripped pipe joint. If the tapered outer wall of the slips is not substantially parallel to and aligned with the tapered inner wall of the master bushing, that can create a situation where the gripping force of the slips in concentrated in a relatively small portion of the inside wall of the slips rather than being evenly distributed throughout the entire inside wall of the slips. Such concentration of gripping force in such a relatively small portion of the inner wall of the slips can (a) crush or otherwise deform the gripped drill pipe, (b) result in excessive and harmful strain or elongation of the drill pipe below the point where it is gripped and (c) cause damage to the slips rendering them inoperable.

This uneven distribution of gripping force is not an uncommon problem, as the rough and tumble nature of oil and gas well drilling operations cause the slips and/or master bushing to be knocked about, resulting in misalignment and/or irregularities in the tapered interface between the slips and the master bushing. This problem is exacerbated as the weight supported by the slips is increased, which is the case for extremely deep wells as discussed above.

BRIEF SUMMARY OF INVENTION

The present invention does away with prior art slips and provides for a drill pipe holder which supports the drill pipe without crushing, deforming, scoring or causing elongation of the drill pipe being held. The holder of the present invention includes wedge members which can be raised out of and lowered into the holder.

The holder is used in combination with an enlarged diameter section of the drill pipe which is spaced apart from the ends of the drill pipe. The enlarged diameter section has a tapered shoulder which corresponds to a tapered shoulder on the movable wedge members of the holder, and the engagement of such shoulders provides support for the drill pipe being held without any of the problems associated with the prior art slips, regardless of the weight of the landing string and casing string.

BRIEF DESCRIPTION OF DRAWINGS

For a further understanding of the nature, objects and advantages of the present invention, reference should be had to the following detailed description, read in conjunction with the following drawings, wherein like reference numerals denote like elements and wherein.

DETAILED DESCRIPTION OF THE INVENTION

Figure 1:
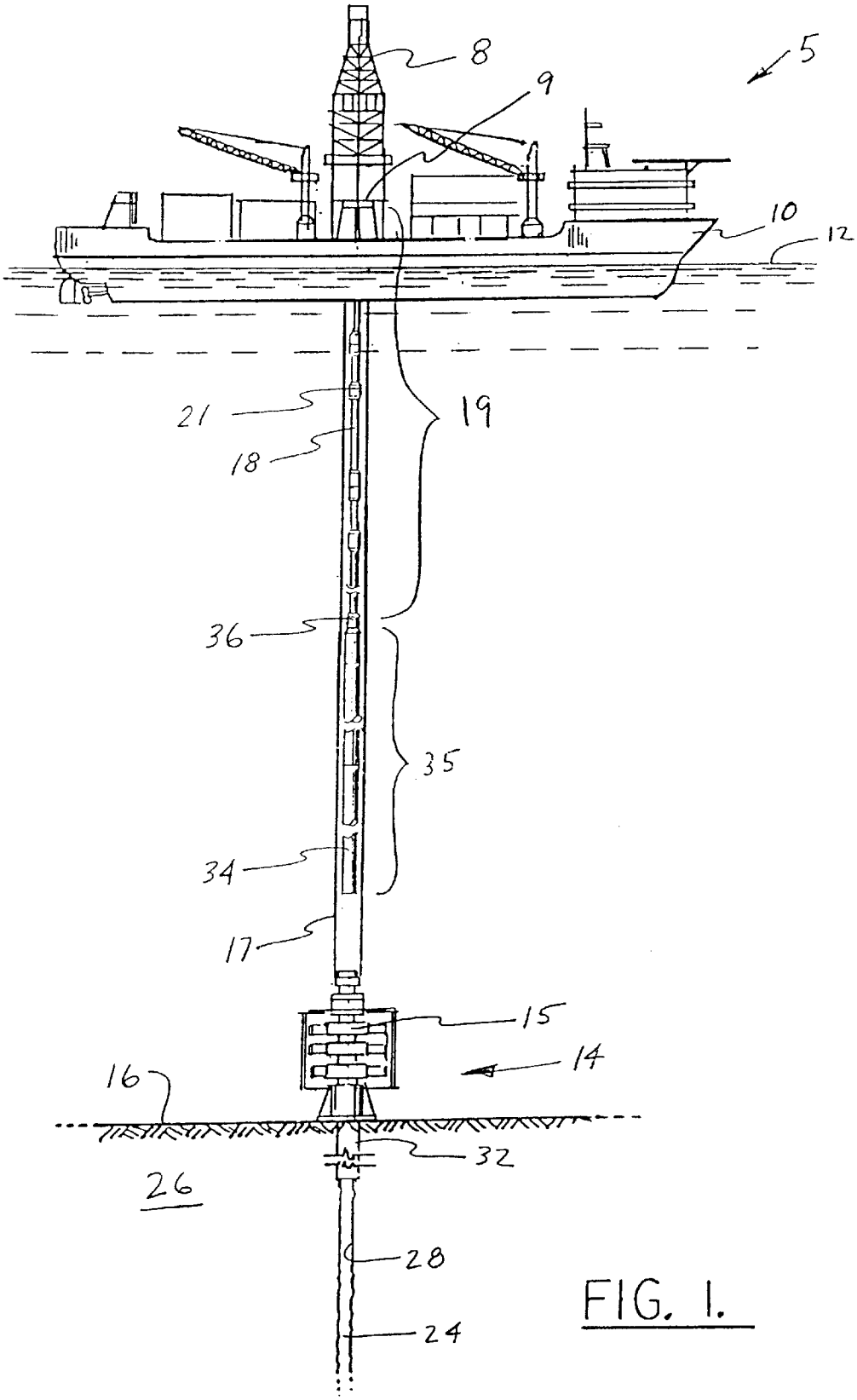
FIG. 1 is an overall elevational view of a drilling rig situated on a floating drill ship, said drilling rig supporting a landing string and casing string extending therefrom in accordance with the present invention toward the borehole that has been drilled into the sea floor.

FIG. 1 depicts generally the present invention 5 in overview. As shown in FIG. 1, drilling rig 8 is situated above ocean surface 12 over the location of undersea well 14 that is drilled below sea floor 16. Numerous lengths or "joints" of drill pipe 18 in accordance with the present invention, attached end-to-end and collectively known as "landing string" 19, extend from rig 8. Numerous lengths or "joints" of casing 34, attached end-to-end and collectively known as "casing string" 35, extend below landing string 19 and are attached to landing string 19 via crossover connection 36. The landing string 19, crossover connection 36 and casing string 35 are situated longitudinally within riser 17 which extends from the rig 8 to undersea well 14.

Figure 2:
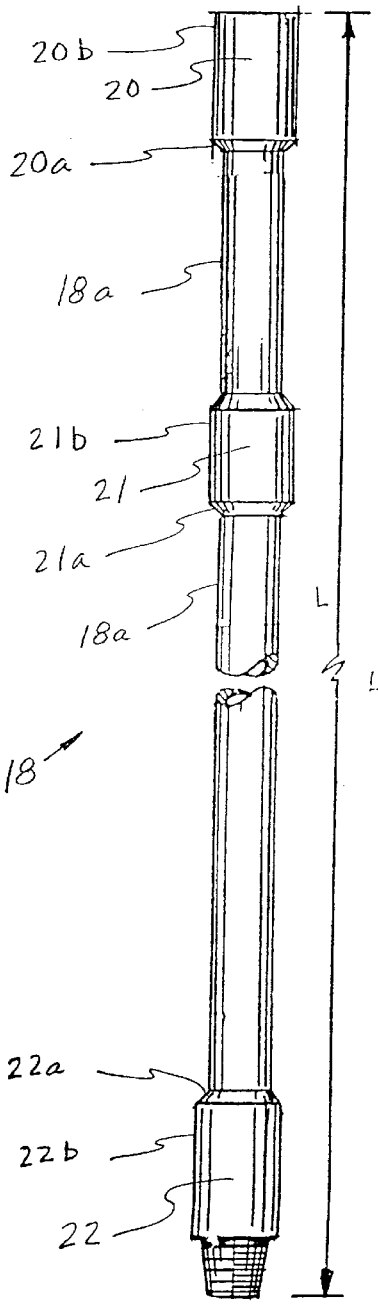
FIG. 2 is an elevational view of drill pipe in accordance with the present invention.
Figure 3:
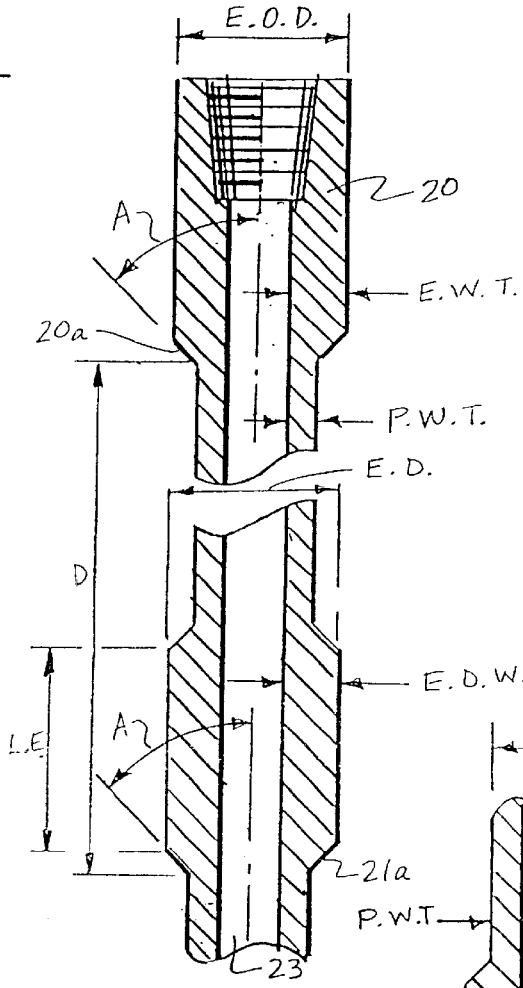
FIGS. 3 and 4 are fragmentary, sectional, elevational views of drill pipe in accordance with the present invention.

FIG. 2 shows a drill pipe 18 in accordance with the present invention. In addition to a female or "box" end 20 and a male or "pin" end 22, drill pipe 18 of the present invention also has an enlarge diameter section 21 which is spaced apart from box end 20 and pin end 22. Enlarged diameter section 21 has an annular shoulder 21*a* which is preferably tapered as shown in FIGS. 2 and 3. Shoulder 21*a* surrounds at least a part and preferably all of the circumferential perimeter of drill pipe 18.

Figure 10:
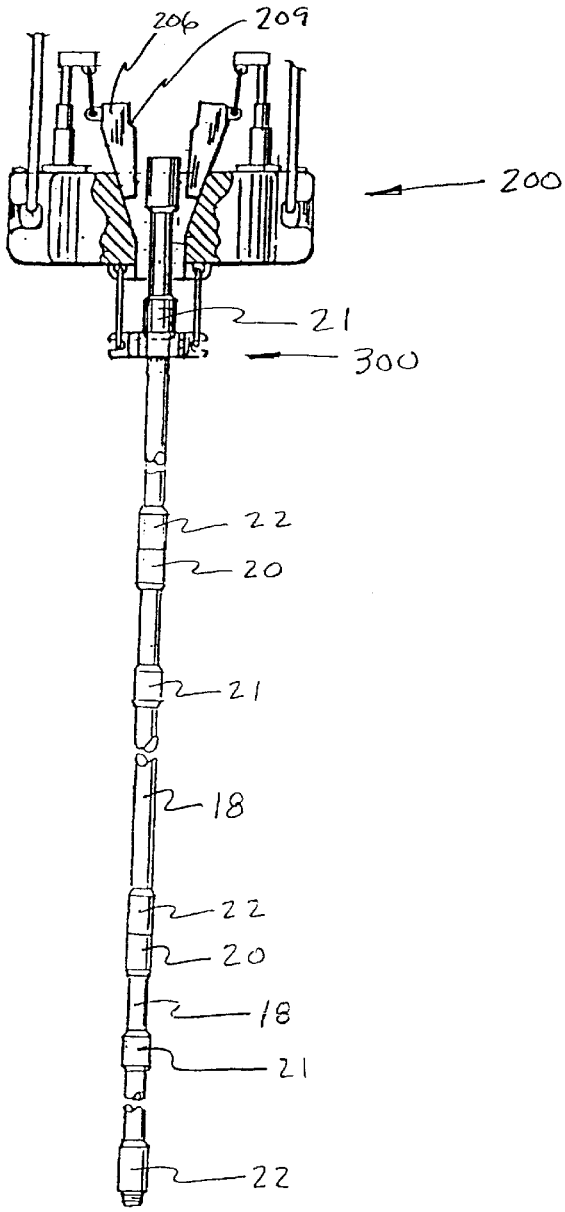
FIG. 10 is an elevational view of the drill pipe and upper and lower holders in accordance with the present invention, in which the lower holder is supporting the landing string extending from the drilling rig, and the auxiliary upper holder is supporting the weight of the joints of drill pipe being added to or removed from the landing string.
Figure 10:
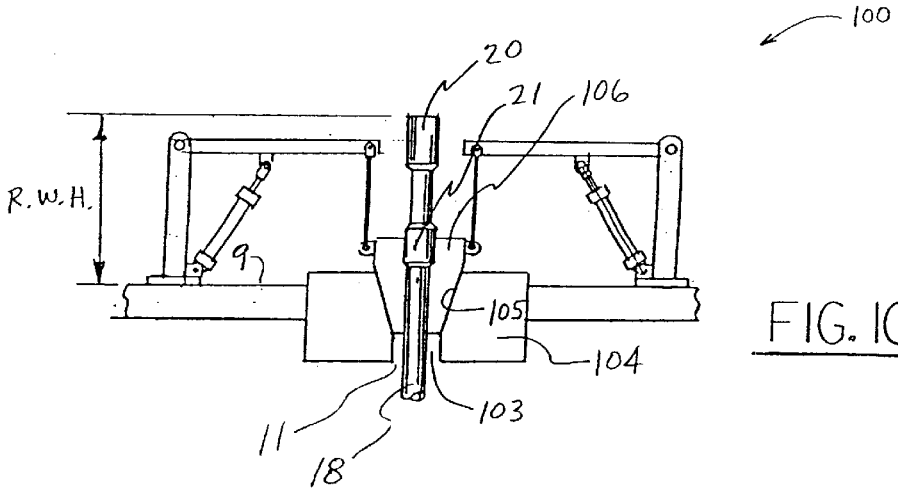

Also in accordance with the present invention, FIG. 10 shows drill pipe lower holder 100 for supporting the landing string 19 during the addition or removal of one or more joints of drill pipe 18 to or from landing string 19. Lower holder 100 is preferably located at the drilling rig floor 9, where it may be situated in or adjacent to the floor.

As also shown in FIG. 10, lower holder 100 includes main body 104 which generally surrounds an opening 11 in rig floor 9 through which landing string 19 protrudes. Main body 104 has an opening 103 and a tapered inner face 105 which defines a tapered bowl generally surrounding landing string 19 which protrudes therethrough.

Figure 5:
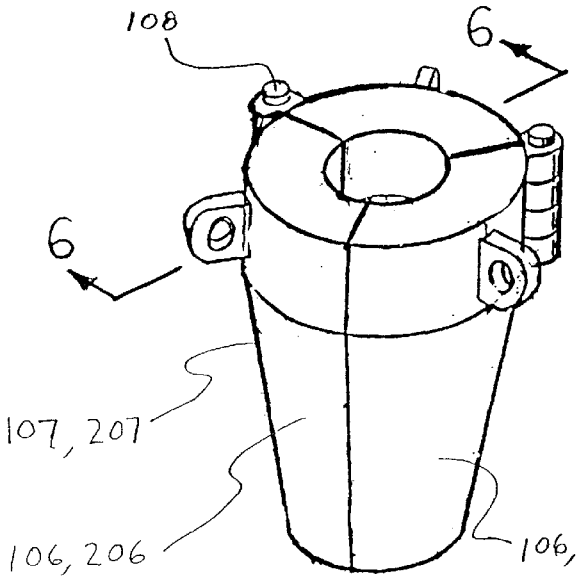
FIG. 5 is a perspective view of the wedge members of the lower and upper holders of the present invention, hinged together and closed.
Figure 7:
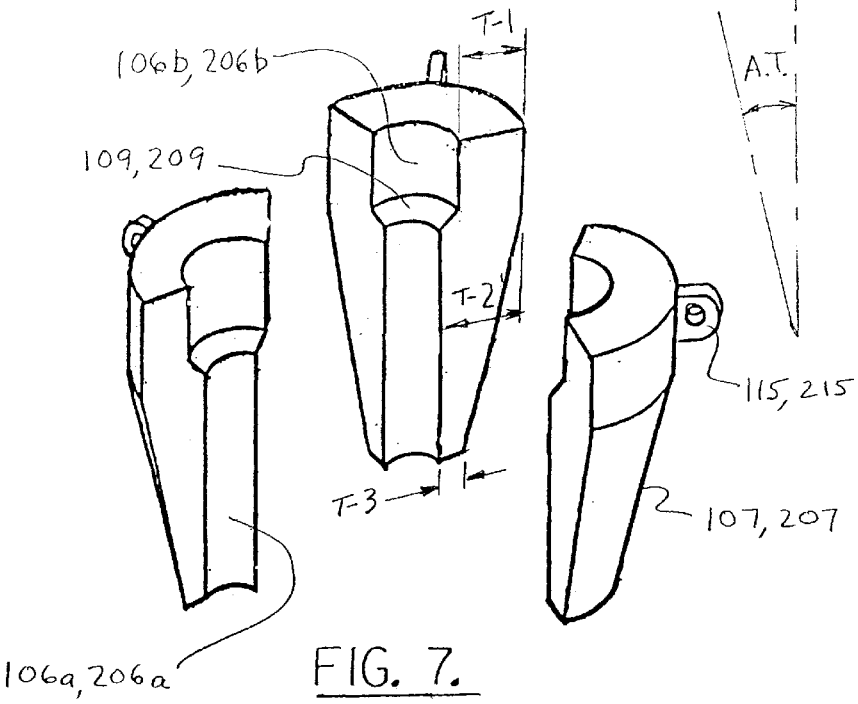
FIG. 7 is a perspective view of the individual, unconnected wedge members of the lower and upper holders of the present invention.
Figure 8:
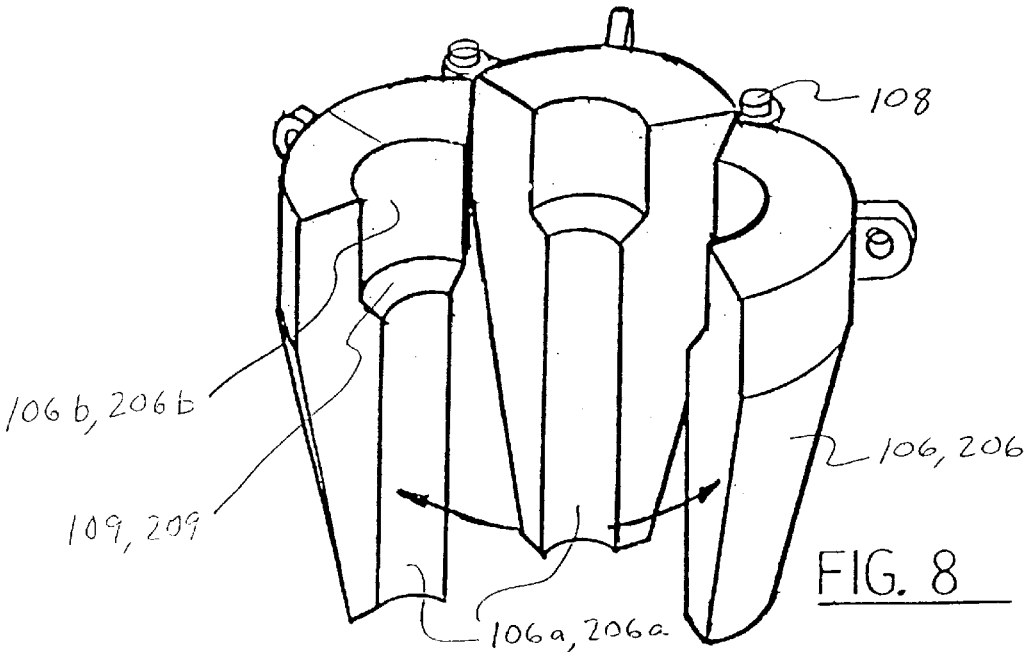
FIG. 8 is a perspective view of the wedge members of the lower and upper holders of the present invention hinged together in an open position.
Figure 11:
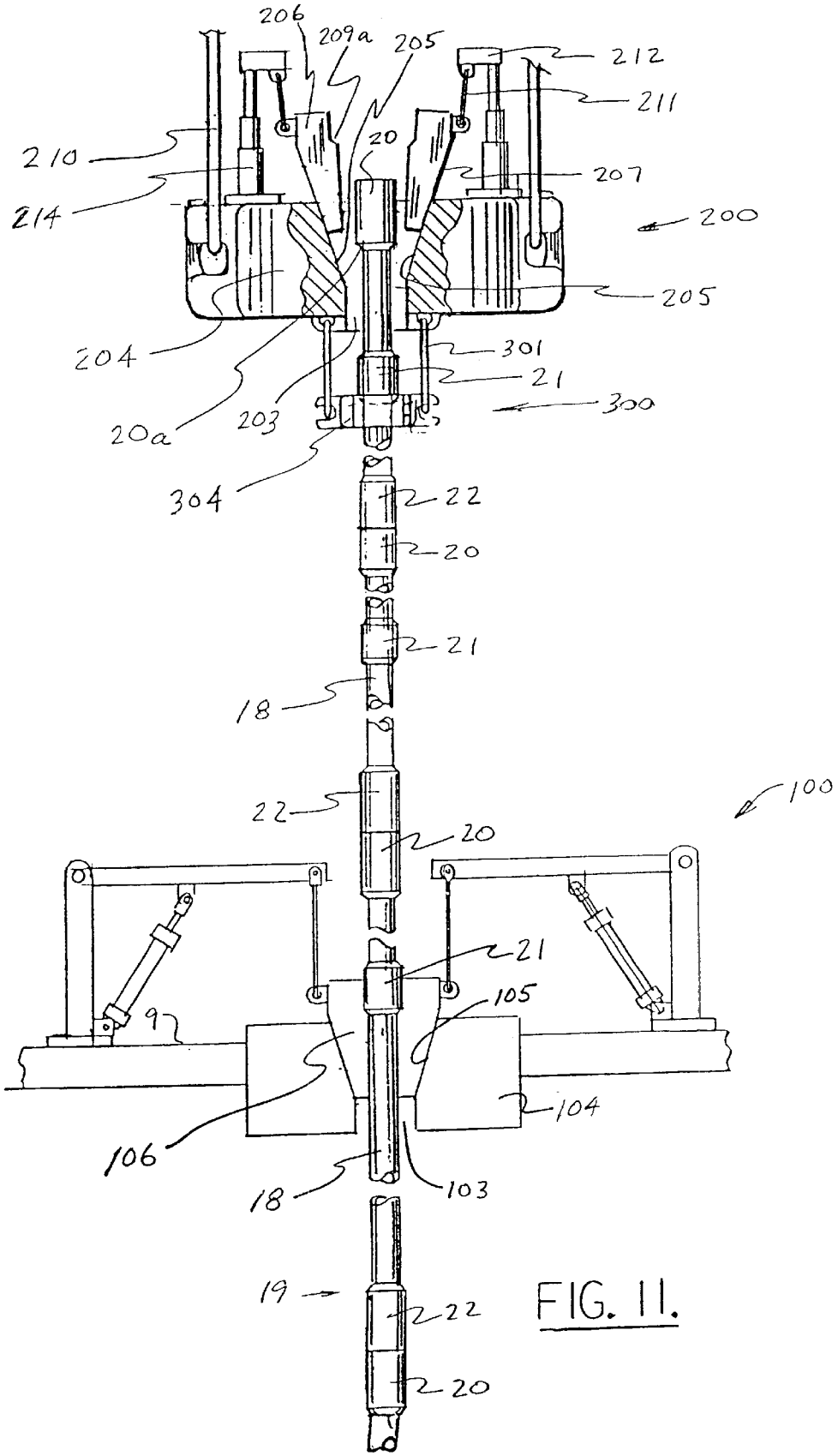
FIG. 11 is an elevational view of the drill pipe and holders in accordance with the present invention, wherein the landing string is being supported by the lower holder, and wherein additional joints of drill pipe have either been just added to or are about to be removed from the landing string being held by the lower holder.
Figure 12:
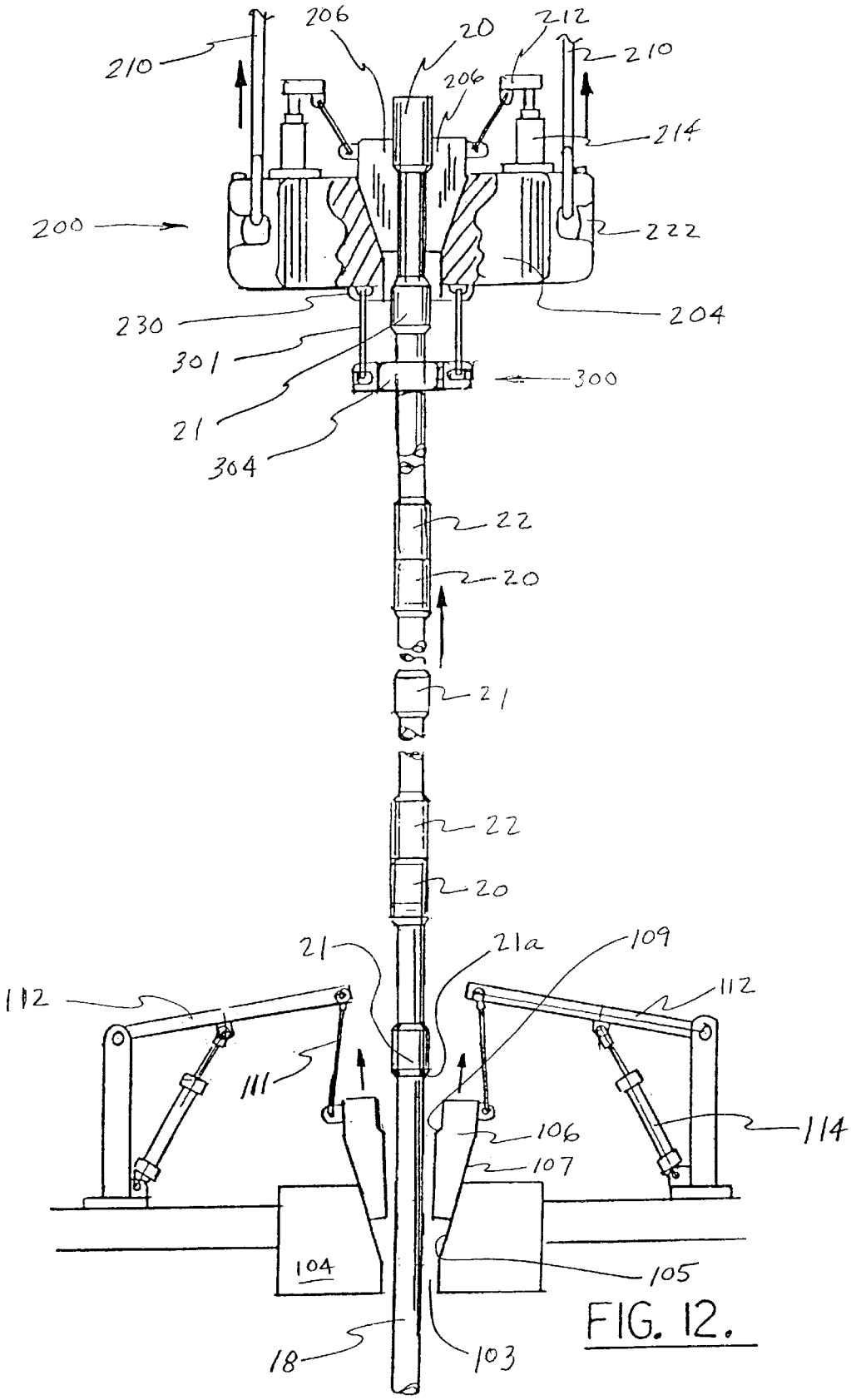
FIG. 12 in an elevational view of the drill pipe and holders in accordance with the present invention, wherein the landing string is supported by the upper holder, and wherein the upper holder and the wedges of the lower holder are being raised slightly so as to clear the wedge members of the lower holder from around the drill pipe prior to lowering the joints of drill pipe which have been added, or, alternatively, where the upper holder has just been used to pull several joints of landing string up as in "tripping out" of the hole.

Lower holder 100 also includes one or more wedge members 106, as depicted in FIGS. 10, 11 and 12. As shown in FIG. 7, the wedge members 106 of the present invention are preferably three in number and are preferably connected by hinges 108 as shown in FIGS. 5 and 8. Wedge members 106 have a tapered outer face 107, as shown in FIGS. 5 and 7, which corresponds with the tapered inner face 105 of main body 104, as shown in FIGS. 11 and 12. The tapered bowl in main body 104 which is defined by its tapered inner face 105 receives wedge members 106 as best depicted in FIGS. 10 and 11.

Figure 6:
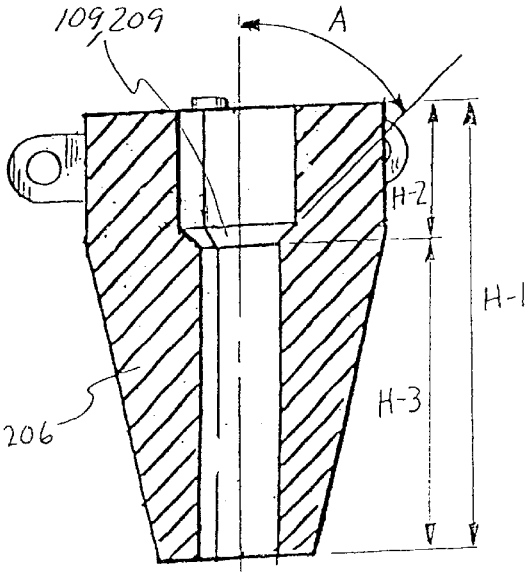
FIG. 6 is a cross sectional view taken along lines 6—6 in FIG. 5.

As shown in FIGS. 6 and 7, the inner side of wedge member 106 has an annular tapered shoulder 109. Tapered shoulder 109 corresponds with tapered shoulder 21*a* of enlarged diameter section 21 of drill pipe 18, as best shown in FIGS. 12 and 11. Tapered shoulder 109 of wedge member 106 is curved, as shown in FIGS. 7 and 8, to correspond with the curved, circumferential shape of shoulder 21*a* of enlarged diameter section 21. The inner side of wedge member 106 also has a curved surface 106*a*, as best shown in FIGS. 7 and 8, which corresponds with and accommodates the curved outer surface 18*a* of drill pipe 18. The inner side of wedge member 106 also has curved surface 106*b*, as best shown in FIGS. 7 and 8, which corresponds with and accommodates the curved outer surface 21*b* of enlarged diameter section 21 of drill pipe 18.

When wedge members 106 are in place in main body 104, as shown in FIGS. 10 and 11, the wedge members form an interface between body 104 and the joint of drill pipe 18 being held by holder 100, the engagement between shoulder 109 of wedge member 106 and shoulder 21*a* of enlarged diameter section 21 providing support for the drill pipe 18 being held by the holder 100.

It should be understood that lower holder 100 of the present invention provides support for landing string 19 by the engagement of shoulder 109 of wedge member 106 with shoulder 21 a of enlarged diameter section 21 of drill pipe 18. Accordingly, unlike prior art slips, it is not necessary for the curved inner surface 106*a* of wedge member 106 to have teeth-like grippers or bear against the drill pipe 18 being supported by the holder. Hence, the present invention overcomes the problems associated with crushing, deformation, scoring and uneven distribution of gripping force associated with prior art slips.

It should be understood that drill pipe 18 depicted in FIG. 10 as being supported by lower holder 100 is the uppermost length or "joint" of drill pipe in landing string 19 depicted in FIG. 1. It should also be understood that lower holder 100 of the present invention supports not only drill pipe 18 which appears in FIG. 10, but also the entire attached landing string 19 and casing string 35 extending from rig 8, as best shown in FIG. 1. In extremely deep wells drilled in extremely deep water for which the present invention is particularly suited, the combined weight of landing string 19 and casing string 35 may range from 950,000 to 2,300,000 pounds. In the future, as deeper wells are drilled in deeper water, it is expected that the present invention may be supporting combined landing string and casing string weight of 4,000,000 pounds or more.

FIG. 1 depicts the installation or "running" of intermediate casing string 35, which will be lowered longitudinally, through blowout preventors 15 and surface casing 32, into position in borehole 24. Although FIG. 1 shows surface casing 32 already cemented into position in borehole 24, it should be understood that the present invention may not only be used to run intermediate casing, but surface and production casing as well. It should also be understood that the present invention, in addition to being used to land casing strings, may also be used to land any other items on or below the sea floor such as blow out preventors, subsea production facilities, subsea wellheads, production strings, drill pipe and drill bits. It should be specifically understood that drill pipe 18 of the present invention may be used in the drilling operation, with drilling fluid being circulated through the lumen 23 of drill pipe 18.

In order to lower casing string 35 from the position shown in FIG. 1 into borehole 24, additional joints of drill pipe 18 are added, usually 1 to 4 at a time, above the joint of drill pipe 18 being held by holder 100, as shown in FIG. 10. FIG. 10 shows three additional joints of drill pipe 18 about to be added, although it should be understood that the number of joints of drill pipe added at a time may vary.

Figure 13:
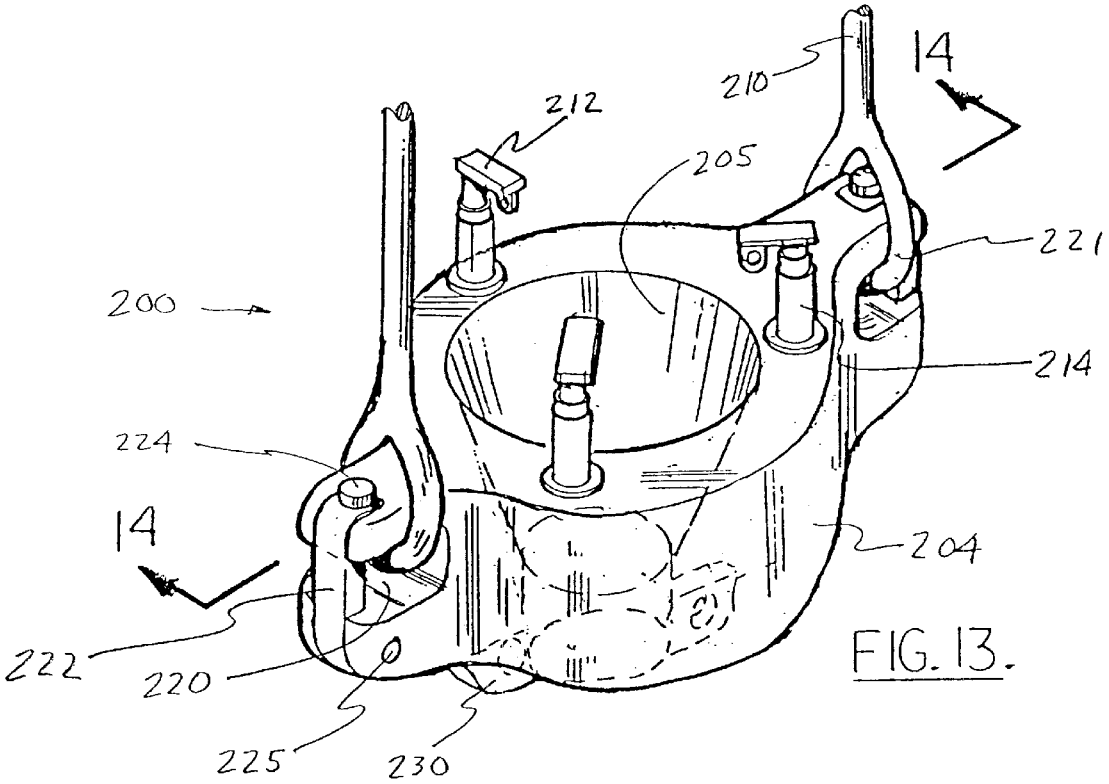
FIG. 13 is a perspective view showing the upper holder without its wedge members and without the auxiliary upper holder.

After the additional joint or joints of drill pipe 18 have been attached, as shown in FIG. 11, landing string 19 and attached casing string 35 may be lowered by a distance roughly equivalent to the length of the newly added joints of drill pipe. This is accomplished via upper holder 200 of the present invention, as depicted in FIG. 11. Upper holder 200 is supported by elevator bails or "links" 210 which in turn are attached to the rig lifting system (not shown). Upper holder 200 includes a main body 204 having an opening 203 which may accommodate the passage of drill pipe 18 therethrough. The opening 203 of main body 204 has a tapered inner face 205 which defines a tapered bowl, as best shown in FIG. 13.

Upper holder 200 also includes one or more wedge members 206 having a tapered outer face 207 which corresponds with the tapered inner face 205 of main body 204. The tapered bowl in main body 204 defined by its tapered inner face 205 receives wedge members 206 as shown in FIGS. 11 and 12. Wedge members 206 of the present invention are preferably three in number and are preferably connected by hinges, similar to wedge members 106 as depicted in FIGS. 5 and 7.

Wedge members 206 of upper holder 200 are preferably shaped and configured similar to wedge members 106 of lower holder 100, although there may be slight variations in size and/or dimensions between wedge members 106 and 206. Similar to tapered shoulder 109 of wedge member 106 as depicted in FIGS. 6 through 8, the inner side of wedge member 206 has an annular tapered shoulder 209. As shown in FIG. 11, tapered shoulder 209 of wedge member 206 corresponds with tapered shoulder 20*a* of box end 20 of drill pipe 18. Similar to tapered shoulder 109 of wedge member 106, tapered shoulder 209 of wedge member 206 is curved to correspond with and accommodate the curved, circumferential shape of shoulder 20a of box end 20.

When wedge members 206 are in place in main body 204, as shown in FIG. 12, the engagement between shoulder 209 of wedge member 206 and shoulder 20*a* of box end 20 of drill pipe 18 being held by holder 200 provides support for said drill pipe 18 being held by holder 200.

Similar to curved surface 106*a* on the inner side of wedge member 106 as shown in FIGS. 7 and 8, the inner side of wedge member 206 also has a curved surface 206*a* which corresponds with and accommodates the curved outer surface 18*a* of drill pipe 18. Similar to curved surface 106*b* on the inner side of wedge member 106 as best shown in FIGS. 7 and 8, the inner side of wedge member 206 also has a curved surface 206*b* which corresponds with and accommodates the curved get outer surface 20*b* of box end 20 of drill pipe 18.

When wedge members 206 are in place in main body 204 of upper holder 200, as shown in FIG. 12, said wedge members form an interface between body 204 and the joint of drill pipe 18 being held by holder 200. In that position, as depicted in FIG. 12, the rig lifting system (not shown) can be used to slightly lift upper holder 200. When that happens, upper holder 200 is supporting the entire load including the landing string 19 and casing string 35, thereby taking the load off wedge members 106 of lower holder 100. Wedge members 106 can then be disengaged, i.e., wholly or partially moved up and away from drill pipe 18, providing sufficient clearance for the landing string 19 to pass unimpeded through the opening 103 in main body 104 of lower holder 100.

Figure 15:
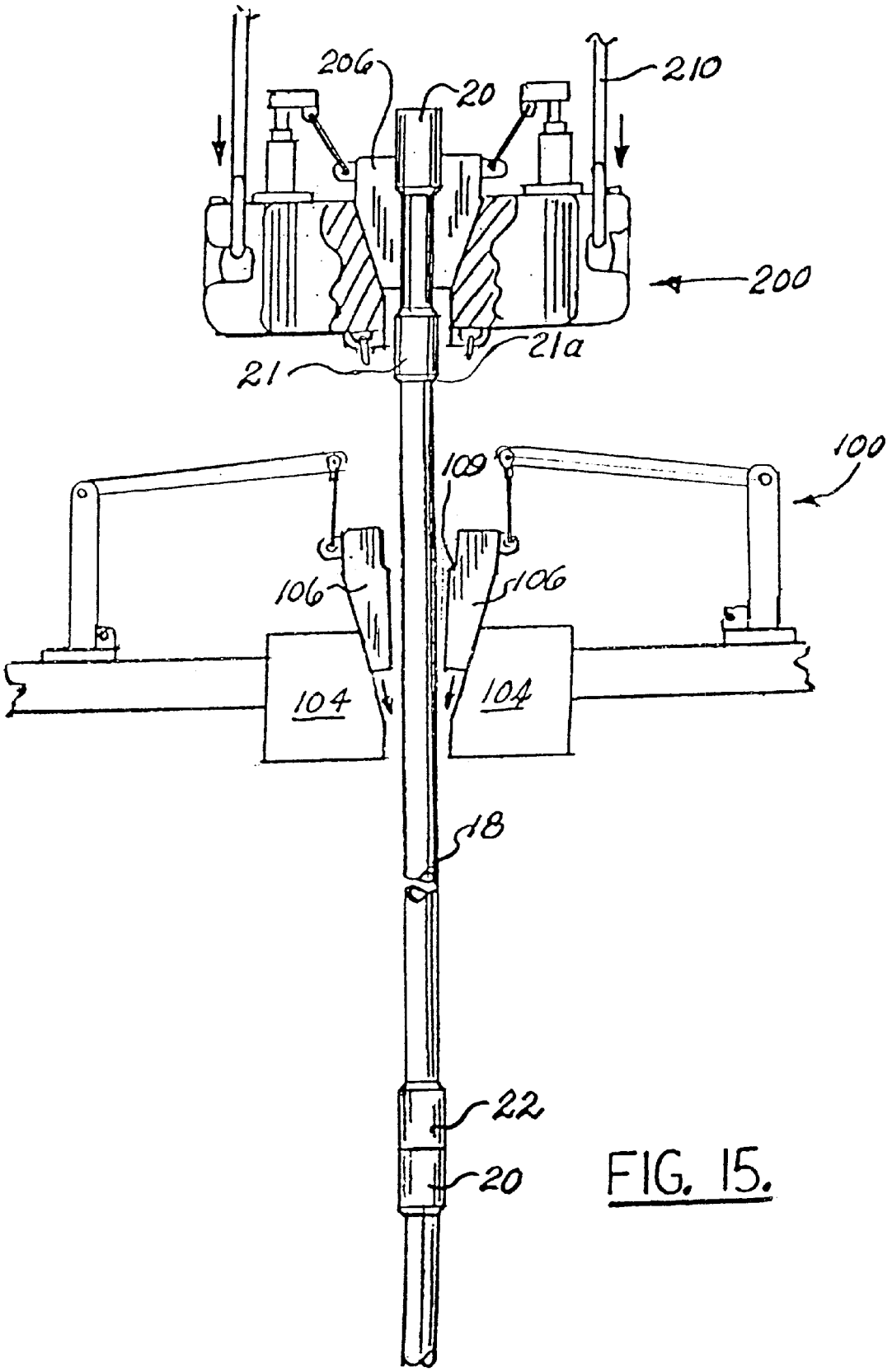
FIG. 15 is an elevational view of the drill pipe and upper and lower holders of the present invention wherein the upper holder has just lowered the drill pipes that were added and wherein the weight of the landing string is about to be transferred from the upper holder to the lower holder.
Figure 16:
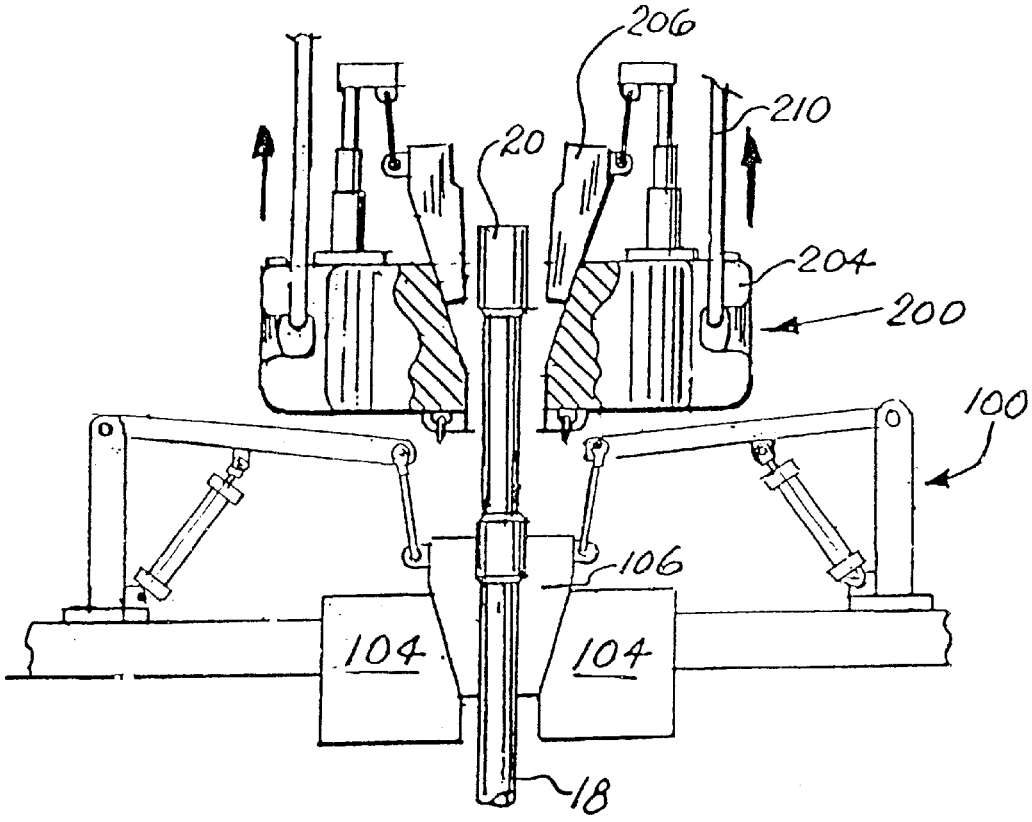
FIG. 16 is an elevational view of the drill pipe and upper and lower holders of the present invention wherein the lower holder is supporting the weight of the landing string and wherein the upper holder is about to be hoisted up so that additional joints of drill pipe may be added to the landing string or, alternatively, wherein the upper holder is about to engage and support the landing string in preparation for "tripping out" of the hole.

The rig lifting system may then be used to lower upper holder 200, along with the landing string and casing string it is supporting, by a distance roughly equivalent to the length of the newly added joints of drill pipe. More specifically, upper holder 200 is lowered until the uppermost enlarged diameter section 21 of newly added drill pipe 18 is located a distance above main body 104 of holder 100 sufficient to provide the vertical clearance needed for reinsertion of wedge members 106 in main body 104, as shown in FIG. 15. At that point, wedge members 106 of lower holder 100 may be placed back into position in main body 104 of holder 100. Upper holder 200 may then be slightly lowered further so as to bring into supporting engagement shoulder 109 of wedge members 106 with shoulder 21*a* of the uppermost enlarged diameter section 21 of newly added drill pipe 19, as shown in FIG. 16. In this fashion, the entire load including the landing string and the casing string is transferred from upper holder 200 to lower holder 100.

Upper holder 200 can then be cleared away from the uppermost end of the landing string. This is accomplished by lowering holder 200 slightly such that wedge members 206 can be 16 disengaged, i.e., moved up and away from box end 20 that was previously being held by holder 200, as shown in FIG. 16. Holder 200 can then be hoisted up by the rig lifting system, permitting clearance for yet additional joints of drill pipe to be added to the upper end of the landing string.

As this process is repeated over and over again, casing string 35 is lowered further and further. This process continues until such time as casing string 35 reaches its proper location in borehole 24, at which point the overall length of landing string 19 spans the distance between rig 8 and undersea well 14.

It should be understood that the rig lifting system referenced herein may be a conventional system available in the industry, such as a National Oilwell 2040-UDBE draworks, a Dreco model "872TB-1250" traveling block and a Varco-BJ "DYNAPLEX" hook, model 51000, said system being capable of handling in excess of 2,000,000 pounds.

Some rigs have specialized equipment to hold aloft additional joints of drill pipe as they are being added to the landing string. However, for those rigs that do not have such specialized equipment, the present invention provides for auxiliary upper holder 300, as shown in FIGS. 10 and 11. Auxiliary holder 300 is suspended below upper holder 200 by connectors 301. Connectors 301 may be cables, links, bails, slings or other mechanical devices which serve to connect auxiliary holder 300 to upper holder 200.

Auxiliary holder 300 has a main body 304 which can be moved from an opened to a closed it position, allowing it to capture and hold aloft the joints of drill pipe 18 to be added to the pipe string, as shown in FIG. 10. The inner surface of main body 304 includes a tapered shoulder which corresponds with tapered shoulder 21*a*. The inner surface of main body 304 is sized to accommodate drill pipe 18 such that when main body 304 is in its closed position and supporting the joints of drill pipe to be added, as shown in FIG. 10, the tapered shoulder of main body 304 engages tapered shoulder 21*a*, providing support for the joints of drill pipe being added. When upper holder 200 is to be used to lower the entire load to the position shown in FIG. 15, auxiliary holder 300 can be swung back, up and out of the way, so that it does not interfere with lower holder 100. Because the combined weight of the relatively few joints of drill pipe being added at any one time is significantly less than the combined weight of the landing string and the casing string extending below the rig, the size and strength of auxiliary upper holder 300 may be substantially less than that of upper holder 200. Auxiliary holder 300 may be a conventional elevator available in the industry, such as the 25-ton model "MG" manufactured by Access Oil Tools.

It should be understood that while the present invention is particularly useful for landing casing strings and other items, the invention may also be used to retrieve items. For example, the invention may be employed to retrieve the landing string and any items attached thereto, such as a drill bit, in an operation commonly referred to as "tripping out of the hole," wherein the operations described hereinabove are essentially reversed. While the landing string is being supported by lower holder 100, as shown in FIG. 16, upper holder 200 is lowered to the position shown in FIG. 16. Wedge members 206 may then be lowered into main body 204 of upper holder 200 so that shoulder 209 of wedge member 206 is brought into supporting engagement with shoulder 20*a* of box end 20.

At that point, the rig lifting system may be used to lift holder 200, thereby transferring the landing string load from lower holder 100 to upper holder 200. This allows wedge members 106 of lower holder 100 to be wholly or partially moved up and away from drill pipe 18, providing sufficient clearance for pipe string 19 to pass unimpeded through the opening 103 in main body 104. It When tripping out of the hole, it is common practice to pull up two or more joints at a time, as would be the case shown in FIG. 12. The landing string would be pulled up by upper holder 200 such that the enlarged diameter section 21 of the drill pipe to be held by lower holder 100 is slightly above wedge members 106, as is shown in FIG. 12. At that point, wedge members 106 would be lowered into position in main body 104. Upper holder 200 may then be slightly lowered further so as to bring into supporting engagement shoulder 109 of wedge member 106 with shoulder 21*a* of enlarged diameter section 21 of the drill pipe being held in holder 100. In this fashion, the entire load is transferred to lower holder 100, permitting the drill pipe that has been pulled up above holder 100 to be detached from the landing string, as would appear in FIG. 10. The removed joints of drill pipe would then be cleared from the upper holder and placed on the drilling rig, permitting upper holder 200 to be lowered again so that more joints of drill pipe could be pulled up, as this process is repeated over and over again until all of the landing string and the items attached thereto have been retrieved.

Figure 4:
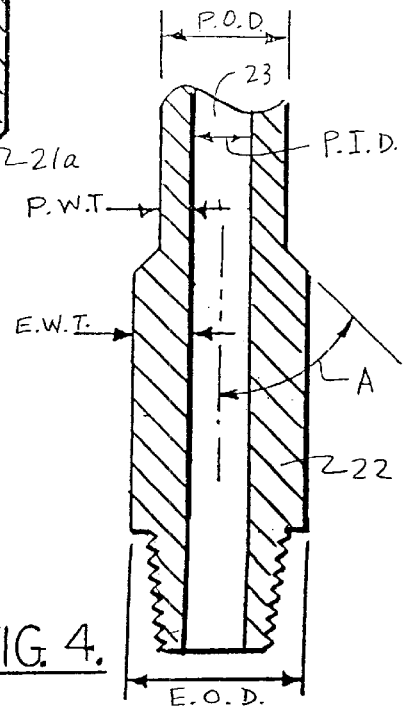

As shown in FIGS. 2–4, drill pipe 18 of the present invention has the following exemplary dimensions:

The end outside diameter (E.O.D.) of pin end 22 and box end 20 is preferably in the range between about 6½ to 9⅞ inches, and most preferably between 7½ and 8 inches.

The end wall thickness (E.W.T.) of pin end 22 and box end 20 is preferably in the range between about 1½ to 3 inches, and most preferably between 2¼ and 2⅜ inches.

The pipe inside diameter (P.I.D.), i.e., the diameter of the uniform bore or lumen 23 extending throughout the length of drill pipe 18, is preferably in the range between about 2 to 6 inches, and most preferably between 2⅓ and 3½ inches.

The pipe wall thickness (P.W.T.), i.e., the thickness of the pipe wall throughout the length of drill pipe 18, except at the ends and at the enlarged diameter section, is preferably in the range between about ⅝ to 2 inches, and most preferably between land 1½ inches.

The pipe outside diameter (P.O.D.), i.e., the outside diameter of drill pipe 18 throughout its length, except at the ends and at enlarged diameter section 21, is preferably in the range between about 4½ to 7⅝ inches, and most preferably between 5 and 6⅝ inches.

The enlarged diameter wall thickness (E.D.W.T.), i.e., the thickness of the pipe wall at enlarged diameter section 21, is preferably in the range between about 1½ to 3 inches, and most preferably between 2¼ and 2⅜ inches.

The length "L" of drill pipe 18 is preferably in the range between about 28 to 45 feet, and most preferably between 28 and 32 feet. It should be understood that length "L" may be any length that can be accommodated by the vertical distance between the rig floor and the highest point of the rig.

The length of the enlarged diameter section (L. E.) is preferably in the range between about 1 to 60 inches, and most preferably between 6 and 12 inches.

The distance "D" between shoulder 21*a* and shoulder 20*a* is preferably in the range between about 2 to 11 feet, most preferably between 3 to 5 feet. The design criteria for distance "D" include the following: (a) the distance "D" should be sufficient to provide adequate clearance, and thereby avoid entanglement, between the bottom of holder

200 and the top of holder 100 when said holders are in the position depicted in FIG. 16; (b) the distance "D" should also be sufficient to permit insertion and removal of wedge members 206 into and out of the tapered bowl of upper holder 200; and (c) the distance "D" should preferably be such that the uppermost end of the drill pipe being supported by lower holder 100 is a reasonable working height (R.W.H.) above rig floor 9, as shown in FIG. 10, so as to permit rig personnel and/or automated handling equipment to assist in attaching or removing joints of drill pipe to or from said uppermost end.

The angle of taper "A" of shoulders 21*a*, 20*a* and 22*a*, which appear in FIGS. 3 and 4, can be any angle greater than 0° and less than 180°, preferably between 10 degrees and 45 degrees, and most preferably 18 degrees. The same angle "A" applies to the angle of taper of shoulder 109 of wedge member 106 and shoulder 209 of wedge member 206, as shown in FIG. 6.

As shown in FIGS. 6 and 7, wedge members 106 and 206 of the present invention have the following exemplary dimensions:

The height ("H-1") of the wedge members is preferably in the range of about 5 to 20 inches, and most preferably between 8 and 16 inches.

The distance ("H-2") between the top of the wedge members and shoulders 109, 209 is preferably in the range of about 2 to 10 inches, and most preferably between 3 and 8 inches.

The distance ("H-3") between the bottom of the wedge members and shoulders 109, 209 is preferably in the range of about 3 to 10 inches, and most preferably between 5 and 8 inches.

The top thickness ("T-1") of the wedge members is preferably in the range of about 1 to 8 inches, and most preferably between 2 and 6 inches.

The thickness ("T-2") of the wedge members at shoulders 109, 209 is preferably in the range of about 1½ to 8½ inches, and most preferably between 2½ and 6½ inches.

The bottom thickness ("T-3") of the wedge members is preferably in the range of about ½ to 6 inches, and most preferably between 1 and 4 inches.

The angle of taper ("A.T.") of outer face 107, 207 of the wedge members can be any angle greater than 0° and less than 180°, preferably between 10 degrees and 45 degrees.

Figure 14:
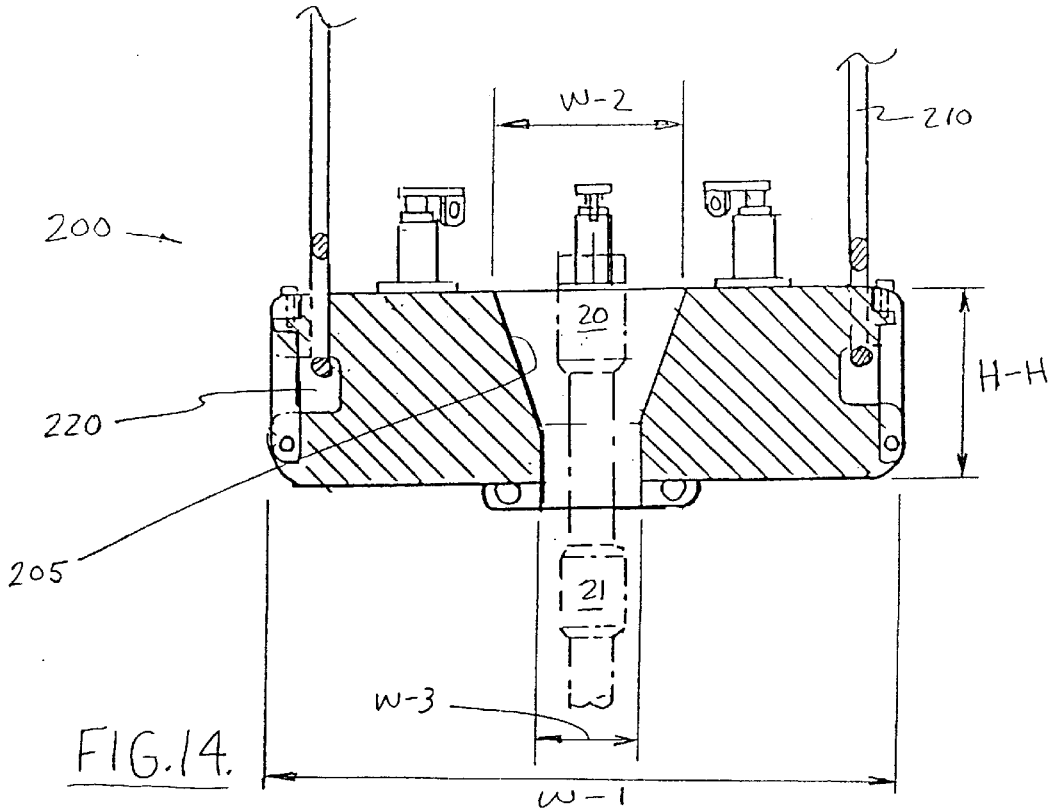
FIG. 14 is a cross sectional view taken along lines 14—14 of FIG. 13.

As shown in FIG. 14, upper holder 200 of the present invention has the following exemplary dimensions:

The height of holder 200 ("H.H.") is preferably in the range of about 18 to 72 inches, and most preferably between 24 and 48 inches.

The width of holder 200 ("W-1") is preferably in the range of about 24 to 72 inches, and most preferably between 36 and 60 inches.

The width of the top of opening 203 ("W-2") of holder 200 is preferably in the range of about 12 to 24 inches, and most preferably between 16 and 21 inches.

The width of the bottom of opening 203 ("W-3") of holder 200 is preferably in the range of about 6 to 18 inches, and most preferably between 9 and 15 inches.

Figure 9:
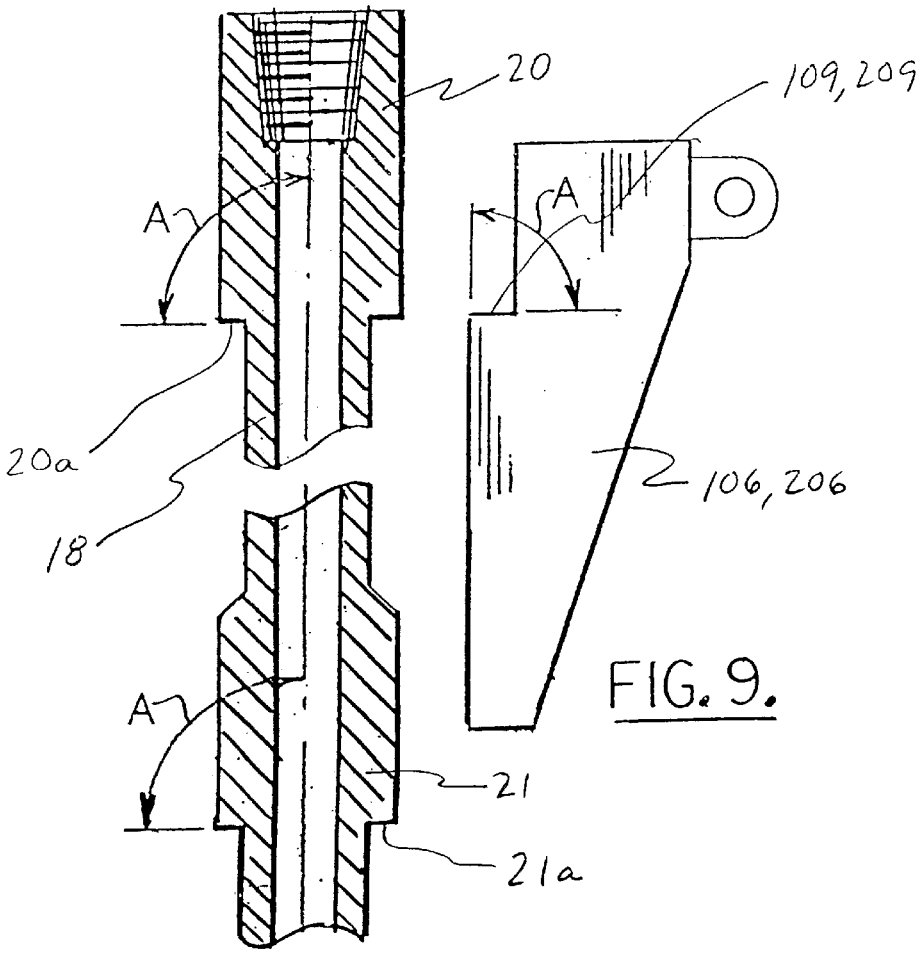
FIG. 9 is a fragmentary, sectional, elevational view of an alternative embodiment of drill pipe in accordance with the present invention, along with a side view of a wedge member used with the alternative embodiment in both the upper and lower holders of the present invention.

FIG. 9 depicts an alternative embodiment of the present invention wherein the shoulders, for example shoulders 21*a* and 20*a*, are square, i.e., wherein angle "A" measures 90 degrees. In that alternative embodiment as depicted in FIG. 9, the shoulders 109 and 209, respectively, of wedge members 106 and 206, respectively, are also square.

In the preferred embodiment of the invention as depicted in FIG. 12, wedge members 106 are lifted out of position by a lifting apparatus which includes lifting arms 112. Lifting arms 112 may be raised and lowered by way of an actuator 114, preferably a pneumatic or hydraulic piston-cylinder arrangement. Lifting arms 112 may be attached directly to wedge members 106 or via connectors 111 as shown in FIG. 12. Connectors 111 may be cables, links, bails, slings or other mechanical devices which serve to connect lifting arms 112 to wedge members 106. Wedge members 106 preferably include lifting eye 115 to facilitate the connection to lifting arms 112. It should be understood that the raising and lowering wedges 106 out of and into position in body 104 can be accomplished in a variety of ways, including manual handling by rig personnel. It should also be understood that the lifting apparatus for raising and lowering wedge members 106 must be sized and configured so as to permit sufficient clearance for upper holder 200 when it is in the position shown in FIGS. 15 and 16.

As depicted in FIGS. 11 and 12, upper holder 200 preferably includes a lifting apparatus for raising and lowering wedge members 206 out of and into position in main body 204. In the preferred embodiment of the invention as depicted in FIG. 12, the lifting apparatus includes lifting arms 212. Lifting arms 212 may be moved up and down by actuator 214, preferably a hydraulic or pneumatic piston-cylinder arrangement. Lifting arms 212 may be attached directly to wedge members 206 or via connectors 211. Connector 211 may be cables, links, bails, slings or other mechanical devices which serve to connect lifting arms 212 to wedge members 206. Wedge members 206 preferably include lifting eyes 215 to facilitate the connection to lifting arms 212.

In the preferred embodiment of the invention as shown in FIG. 13, upper holder 200 is removably attached to elevator links 210. Main body 204 of upper holder 200 is preferably comprised of steel having recessed areas 220 to accommodate therein placement of elevator link eyes 221. Elevator link eyes 221 are retained in the position shown in FIGS. 13 and 14 by link retainers 222. Link retainers 222 may be moved from the closed position shown in FIG. 14 to an open position by lifting release pins 224, thereby permitting retainer links 222 to pivot about hinge pin 225 to an open position, thus permitting removal of upper holder 200 from elevator links 210. As best depicted in FIG. 12, upper holder 200 is also provided with lifting eyes 230 to which connectors 301 may be attached.

Figure 17:
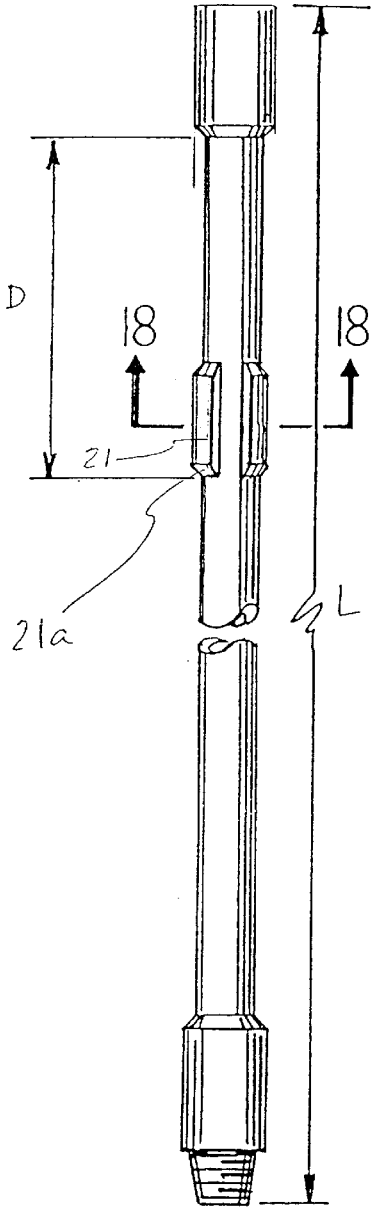
FIG. 17 is an elevational view of an alternative embodiment of the drill pipe in accordance with the present invention.
Figure 18:
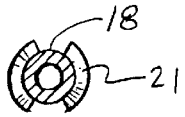
FIG. 18 is a cross sectional view taken along lines 18—18 of FIG. 17.

FIGS. 17 and 18 depict an alternative embodiment of the present invention in which enlarged diameter section 21 is not enlarged completely around the circumference of drill pipe 18. In this alternative embodiment of enlarged diameter section 21, shown in cross section in FIG. 18, there may be one or more cross sectional gaps in section 21 where the diameter is not enlarged.

In the preferred embodiment of the invention, drill pipe 18, including box end 20, enlarged diameter section 21 and pin end 22, is made from a single piece of pipe of uniform wall thickness having the dimension E.W.T. in FIG. 4, said thickness being reduced at intervals along the pipe by milling between box end 20 and enlarged diameter section 21, and by milling between pin end 22 and enlarged diameter section 21. It should be understood that in such preferred embodiment of the invention, box and pin ends 20 and 22 and enlarged diameter section 21 are integral with the pipe, i.e., box end 20 and pin end 22 are not created by welding or otherwise attaching said ends to drill pipe 18, nor is enlarged diameter section 21 created through welding or other means of attachment.

In the preferred embodiment of the invention, each joint of drill pipe 18 is made of steel and weighs between 800 to 5,000 pounds, most preferably between 1,000 to 2,000 pounds, or approximately 29 to 110 pounds per linear foot, most preferably 32 to 75 pounds per linear foot.

Alternatively, drill pipe 18 of the present invention may be made of a piece of pipe of uniform thickness, referenced as P.W.T. in FIG. 4, with attached box and pin ends, and with an attached enlarged diameter section 21. In this alternative embodiment, the box end, pin end and enlarged diameter section may be attached to the pipe by welding, bolting or other means.

Figure 19:
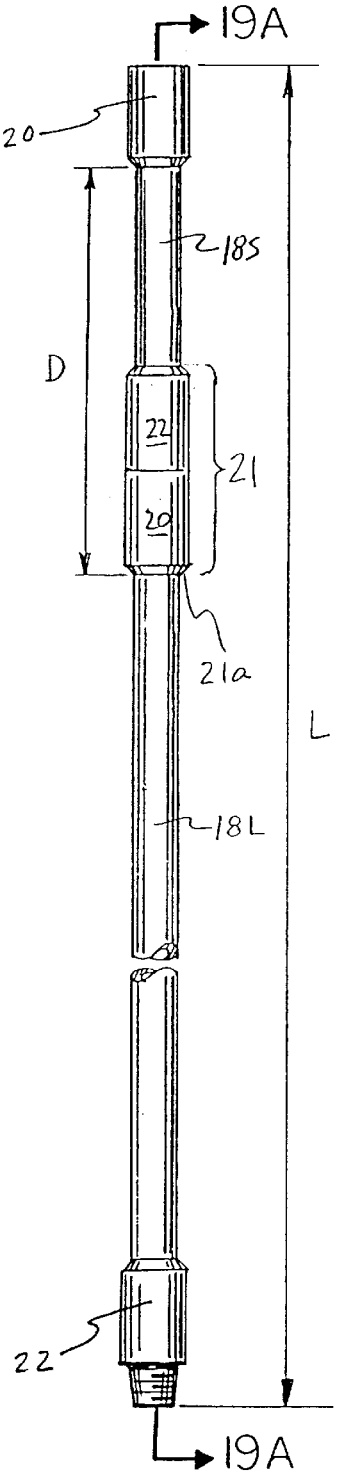
FIG. 19 is an elevational view of an alternative embodiment of drill pipe in accordance with the present invention.
Figure 19A:
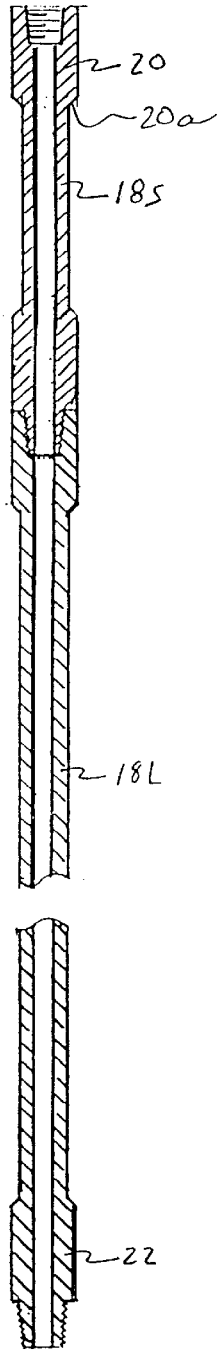
FIG. 19A is a cross sectional view taken along lines 19A—19A of FIG. 19.
Figure 21:
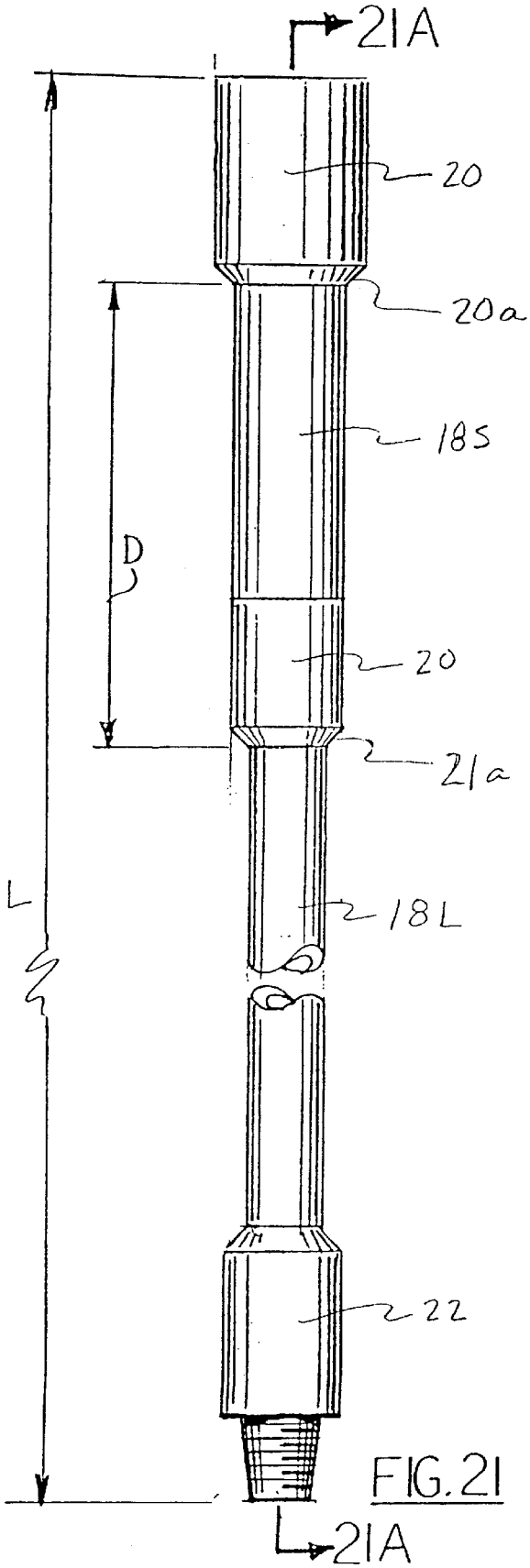
FIG. 21 is an elevational view of another alternative embodiment of drill pipe in accordance with the present invention.
Figure 21A:
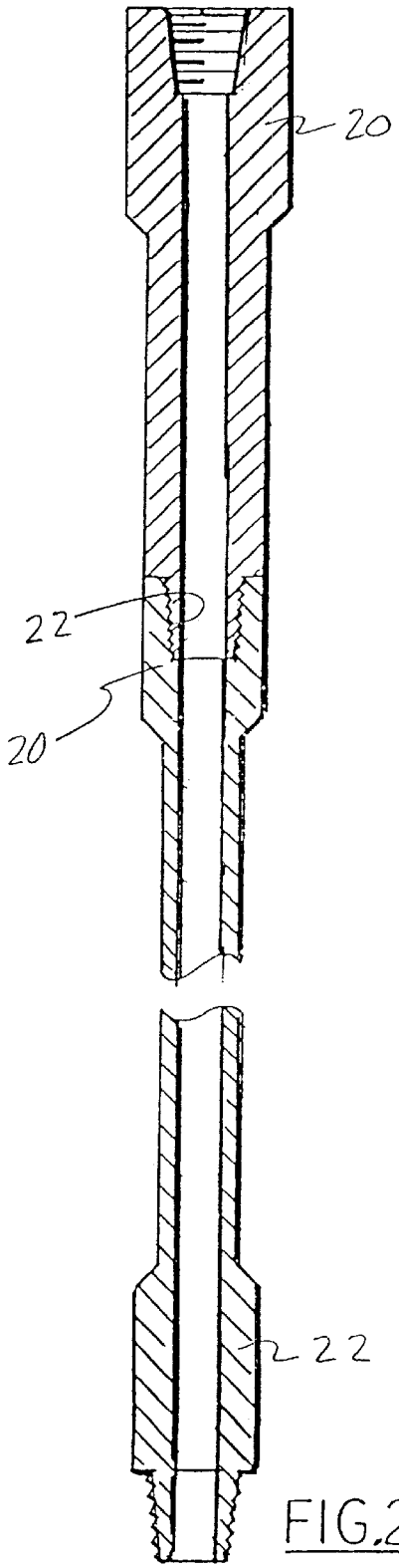
FIG. 21A is a cross sectional view taken along lines 21A—21A of FIG. 21.

In a further alternative embodiment of the present invention, drill pipe 18 may be made from titanium or from a carbon graphite composite. FIGS. 19 and 21 show further alternative embodiments of the present invention in which drill pipe 18, having a length "L", is comprised of two separate drill pipes, 18S and 18L, the former being shorter than the latter, each one having a female end 20 and a male end 22. As shown in FIGS. 19 and 21, 18S is attached end-to-end with 18L. In the alternative embodiment depicted in FIG. 19, the mated male end 22 and female end 20 combine to form enlarged diameter section 21, having a tapered shoulder 21*a* defined by the tapered shoulder of mated female end 20. In the alternative embodiment depicted in FIG. 21, the mated female end 20 serves as enlarged diameter section 21, with the shoulder of said mated female end serving as shoulder 21*a*.

Figure 22:
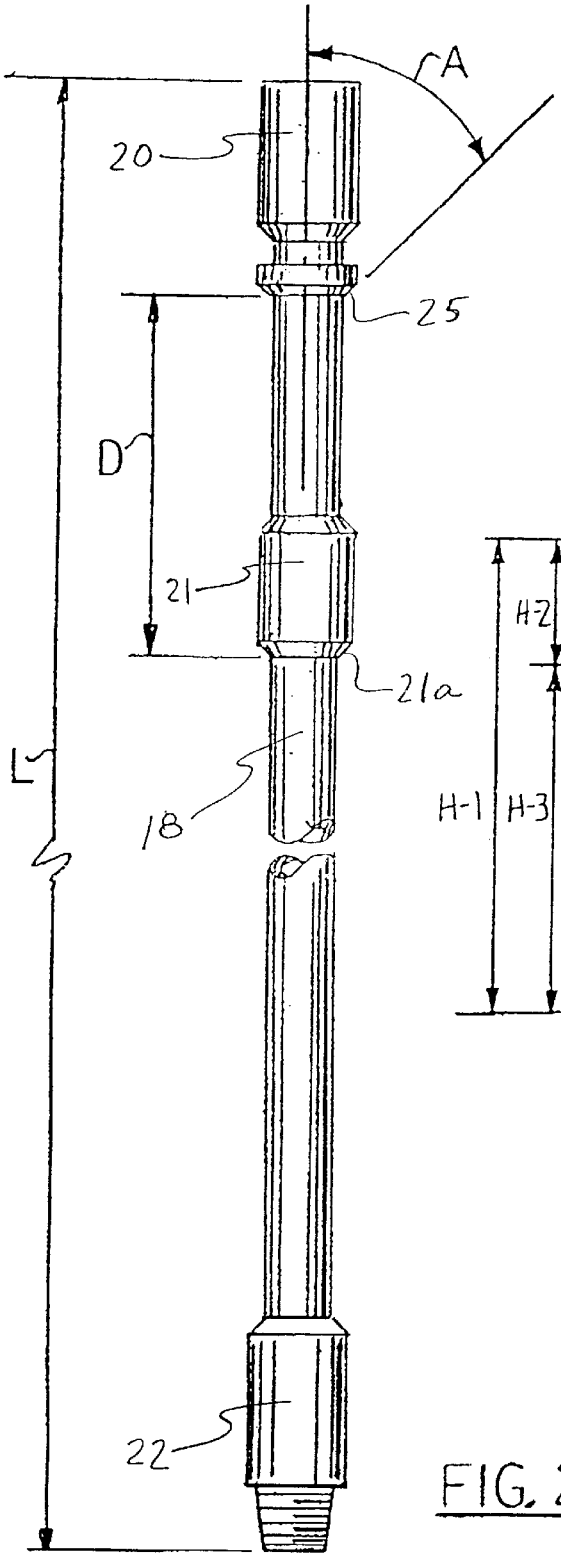
FIG. 22 is an elevational view of yet another alternative embodiment of the present invention.

In yet a further alternative embodiment of the present invention shown in FIG. 22, an extra tapered shoulder 25 is provided on drill pipe 18 between enlarged diameter section 21 and the end of the drill pipe. In this embodiment of the invention, extra tapered shoulder 25 has an angle of taper "A" that corresponds with and is engaged by shoulder 209 of wedge members 206, thereby providing support for the drill pipe being held by upper holder 200. In this embodiment, "D" is the distance between shoulder 21*a* and shoulder 25.

The distance "D", the angle "A" and the length "L" in the alternative embodiment shown in FIGS. 17, 19, 21 and 22 are comparable to those of the preferred embodiment as shown in FIG. 3.

Figure 23:
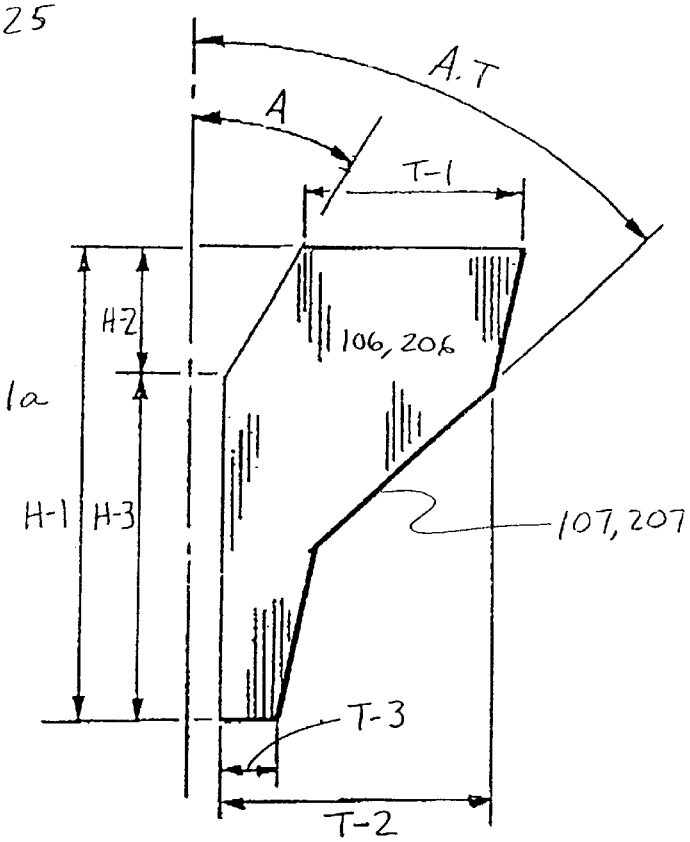
FIG. 23 is an elevational side view of a further alternative embodiment of wedge members in accordance with the present invention.

FIG. 23 depicts a further alternative embodiment of wedge members 106, 206 in accordance with the present invention. The dimensions H-1, H-2, H-3, T-1, T-2 and T-3, and the angles A and A.T. in the alternative embodiment shown in FIG. 23 are comparable to those of the embodiment as shown in FIG. 6.

Figure 20:
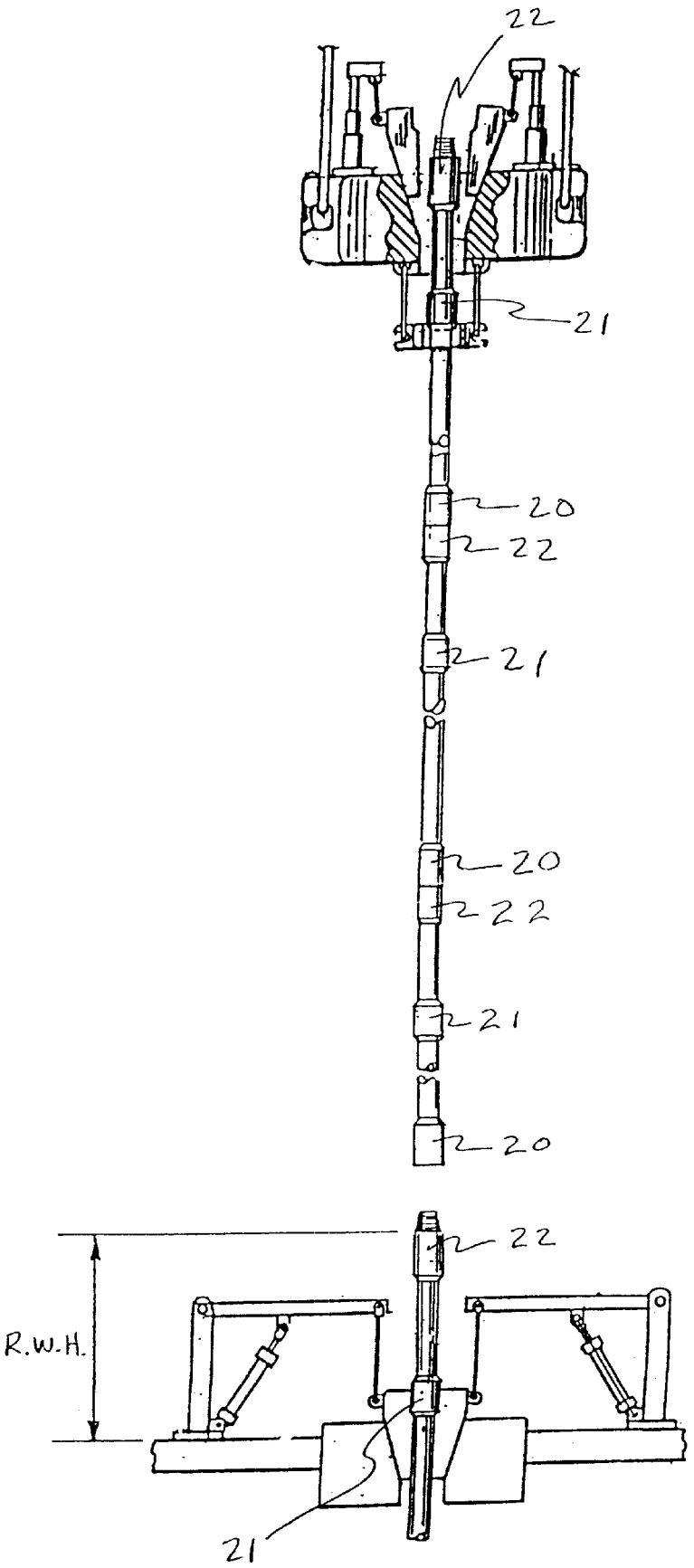
FIG. 20 is an elevational view of an alternative embodiment of the present invention in which the joints are run with the female end down and the male end up.

It should be understood that in an alternative embodiment of the present invention, the drill pipe may be run with the male or pin end 22 up and the female or box end 20 down, as depicted in FIG. 20. In this alternative embodiment of the invention, tapered shoulder 209 of wedge member 206 corresponds with tapered shoulder 22*a* of pin end 22 of drill pipe 18; shoulder 209 is curved to correspond with and accommodate the curved, circumferential shape of shoulder 22*a*; and curved surface 206*b* of wedge member 206 corresponds with and accommodates the curved outer surface 22*b* of drill pipe 18.

Crossover connection 36 depicted in FIG. 1 may include an "SB" Casing Hanger Running Tool in conjunction with an "SB" Casing Hanger, all manufactured by Kvaerner National Oilfield Products.

It should be understood that drilling rig 8 includes a drill platform having floor 9 with a work area for the rig personnel who assist in the various operations described herein. Although FIG. 1 shows drilling rig 8 situated on a drill ship 10, it should be understood that the present invention may be used on drilling rigs situated on platforms that are permanently affixed to the sea floor, or on semi-submersible and other types of deep water rigs. Moreover, although the invention is particularly useful for rigs drilling in deep water, the invention may also be used with shallow-water rigs and with rigs drilling on land.

The following table lists the part numbers and part descriptions as used herein and in the drawings attached hereto:

PARTS LIST

| PART NUMBER | DESCRIPTION |
|---|---|
| 5 | invention in general overview |
| 8 | drilling rig |
| 9 | drilling rig floor |
| 10 | drill ship |
| 11 | opening in drilling rig floor |
| 12 | surface of ocean |
| 14 | undersea well |
| 15 | blowout preventors |
| 16 | sea floor |
| 17 | riser |
| 18 | drill pipe |
| 18a | curved outer surface of drill pipe |
| 18S | shorter joint of drill pipe of alternative embodiment |
| 18L | longer joint of drill pipe of alternative embodiment |
| 19 | landing string |
| 20 | box (female) end of drill pipe |
| 20a | tapered shoulder of box end |
| 20b | curved outer surface of box end |
| 21 | enlarged diameter section of drill pipe |
| 21a | supporting shoulder of enlarged diameter section |
| 21b | curved outer surface of enlarged diameter section |
| 22 | pin (male) end of drill pipe |
| 22a | tapered shoulder of pin end |
| 22b | curved outer surface of pin end |
| 23 | lumen of drill pipe 18 |
| 24 | borehole |
| 25 | extra tapered shoulder |
| 26 | earthen formation |
| 28 | wall of borehole |
| 32 | surface casing |
| 34 | intermediate casing |
| 35 | casing string |
| 36 | crossover connection |
| 100 | lower holder |
| 103 | opening in main body 104 |
| 104 | main body of lower holder |
| 105 | tapered inner face of main body 104 |
| 106 | wedge members of lower holder |
| 106a | curved inner surface of wedge member 106 accommodating drill pipe |
| 106b | curved inner surface of wedge member 106 accommodating enlarged diameter section 21 |
| 107 | tapered outer face of wedge members 106 |
| 108 | hinges connecting wedge members |
| 109 | tapered shoulder of wedge members 106 |
| 111 | connectors between wedge members 106 and lifting arms 112 |
| 112 | lifting arms for lifting wedge members 106 |
| 114 | actuator for moving lifting arm 112 |
| 115 | lifting eye on wedge member 106 |
| 200 | upper holder |
| 203 | opening in main body of upper holder |
| 204 | main body of upper holder |
| 205 | tapered inner face of main body 204 |
| 206 | wedge members of upper holder |
| 206a | curved inner surface of wedge member 206 accommodating drill pipe |
| 206b | curved inner surface of wedge member 206 accommodating end of drill pipe |
| 207 | tapered outer face of wedge member 206 |
| 209 | tapered shoulder of wedge member 206 |

-continued

PARTS LIST

| PART NUMBER | DESCRIPTION |
|---|---|
| 210 | elevator links |
| 211 | connectors between wedge member 206 and lifting arms 212 |
| 212 | lifting arm for lifting wedge member 206 |
| 214 | actuator for moving lifting arm 212 |
| 215 | lifting eye on wedge member 206 |
| 220 | recessed area of upper holder |
| 221 | eye of elevator link |
| 222 | elevator link retainer |
| 224 | release pin |
| 225 | hinge |
| 230 | lifting eyes to support auxiliary upper holder |
| 300 | auxiliary upper holder |
| 301 | connectors for auxiliary holder 300 |
| 304 | main body of holder 300 |

The following table lists and describes the dimensions used herein and in the drawings attached hereto:

DIMENSION LIST

| DIMENSION | DESCRIPTION |
|---|---|
| E.O.D | end outside diameter of pin end and box end of drill pipe |
| E.W.T. | end wall thickness of pin end and box end of drill pipe |
| P.I.D. | pipe inside diameter |
| P.W.T. | pipe wall thickness |
| P.O.D. | pipe outside diameter |
| E.D.W.T. | enlarged diameter wall thickness |
| R.W.H. | reasonable working height of box end above rig floor |
| L | length of drill pipe |
| D | distance between supporting shoulders |
| A | angle of shoulder taper |
| LE | length of enlarged diameter section |
| T-1 | top thickness of the wedge member |
| T-2 | thickness of the wedge member at the shoulder |
| T-3 | bottom thickness of the wedge member |
| H-1 | height of the wedge member |
| H-2 | distance between the top of the wedge member and the shoulder |
| H-3 | distance between the bottom of the wedge member and the shoulder |
| A.T. | Angle of taper of the outer face of the wedge member |
| H.H. | Height of upper holder |
| W-1 | width of upper holder |
| W-2 | width of top of opening of upper holder |
| W-3 | width of bottom of opening of upper holder |

The foregoing embodiments are presented by way of example only; the scope of the present invention is to be limited only by the following claims;

What is claimed is:

1. A drilling rig, pipe, and pipe support apparatus, comprising:

a) a drilling rig having a floor;

b) a landing string comprised of a number of joints of drill pipe connected end to end, extending from the rig, that generate a huge tensile load at the floor;

c) a drill pipe holder, located at the rig floor, that holds a joint of drill pipe of the landing string and supports the landing string during the addition or removal of a joint of drill pipe to or from the landing string;

d) wherein the holder and the joint of drill pipe that is held by the holder are configured to support the tensile load of the landing string with correspondingly shaped annular shoulders that engage when the holder holds the joint of drill pipe;

e) the bolder including a main body and a plurality of wedge members, the wedge members forming an interface between the body and the joint of drill pipe being held by the holder.

2. The drilling rig, pipe, and pipe support apparatus of claim 1 wherein the holder does not have teeth.

3. The drilling rig, pipe, and pipe support apparatus of claim 1 further comprising a casing string supported by the landing string.

4. The drilling rig, pipe, and pipe support apparatus of claim 3 wherein the combined weight of the landing string and casing string is between about 950,000 and 2,300,000 pounds.

5. The drilling rig, pipe, and pipe support apparatus of claim 1 wherein the landing string and casing string are configured so that the overall combined length of the landing string and casing string spans the distance between the drilling rig and the well location.

6. The drilling rig, pipe, and pipe support apparatus of claim 5 wherein the combined weight of the landing string and casing string is between about 950,000 and 2,300,000 pounds.

7. The drilling rig, pipe, and pipe support apparatus of claim 5 wherein the combined weight of the landing string and casing string is between about 800,000 and 4,000,000 pounds.

8. The drilling rig, pipe, and pipe support apparatus of claim 1 wherein the wedge members do not have teeth that bite into the surface of the drill pipe.

9. The drilling rig, pipe, and pipe support apparatus of claim 1 wherein each joint of pipe has a pin end and a box end, and wherein the holder has a tapered bowl that receives the wedge members and each of the wedge member has an interior surface with a curved shoulder that engages the correspondingly shaped curved shoulder on the drill pipe being held by the holder at a position spaced apart from the box or pin end of the drill pipe.

10. The drilling rig, pipe, and pipe support apparatus of claim 1 wherein each wedge member has a shoulder, the shoulders of the wedge members engaging the shoulder of the drill pipe being held by the holder.

11. The drilling rig, pipe, and pipe support apparatus of claim 1 wherein each pipe joint has a pin end and a box end and an enlarged diameter section, and wherein the enlarged diameter section is spaced between one and eight feet from the box or pin ends.

12. The drilling rig, pipe, and pipe support apparatus of claim 11 wherein at least one of the ends of the pipe joint and the enlarged diameter section have correspondingly shaped shoulders.

13. The drilling rig, pipe, and pipe support apparatus of claim 11 wherein both of the ends of the pipe joint and the enlarged diameter section have correspondingly shaped shoulders.

14. The drilling rig, pipe, and pipe support apparatus of claim 1 wherein each joint of pipe has a weight of between about 29 and 110 pounds per linear foot.

15. The drilling rig, pipe, and pipe support apparatus of claim 1 wherein the shoulders form an angle of between about 10 and 45 degrees with the central longitudinal axis of each joint of pipe.

16. A pipe and pipe support apparatus comprising:

a) a landing string comprised of a number of joints of pipe connected end to end that generate a huge tensile load, each joint of pipe having pin and box end portions and an enlarged diameter section spaced in between the pin and box end, but closer to the box end portion;

b) a pipe holder that holds a joint of pipe of the landing string and supports the landing string at the enlarged diameter section during the addition or removal of a joint of pipe to or from the landing string;

c) wherein the holder and the joint of pipe that is held by the holder are configured to support the tensile load of the landing string with correspondingly shaped annular shoulders that engage when the holder holds the joint of pipe; and d) the holder including a main body and a plurality of wedge members, the wedge members forming an interface between the body and the joint of pipe being held by the holder.

17. A drilling rig, pipe, and pipe support apparatus, comprising:

a) a drill platform having a floor with a work area;

b) a landing string comprised of a number of joints of drill pipe connected end to end that generate a huge tensile load at the floor, each joint having enlarged, pin and box end portions, an enlarged diameter section that is positioned between the pin and box end portions, the majority of each joint of drill pipe being of a smaller, generally uniform diameter;

c) the floor having a drill pipe holder that supports the landing string during the addition or removal of a joint of drill pipe to or from the landing string;

d) wherein the holder and an uppermost joint of drill pipe that is supported by the holder are configured to support the tensile load of the landing string at the enlarged diameter section with correspondingly shaped tapered annular shoulders that engage when the holder supports the uppermost joint of drill pipe at the enlarged diameter section;

e) the holder including a main body and a plurality of wedge members that form an interface between the body and the uppermost joint of drill pipe at the engaged annular shoulder.

18. The drilling rig, pipe, and pipe support apparatus of claim 17 wherein the drill pipe has a weight of between 29 and 110 pounds per foot.

19. The drilling rig, pipe, and pipe support apparatus of claim 17 further comprising a casing string supported by the landing string.

20. The drilling rig, pipe, and pipe support apparatus of claim 19 wherein the combined weight of the landing string and casing string is between about 950,000 and 2,300,000 pounds.

21. The drilling rig, pipe, and pipe support apparatus of claim 17 wherein the drilling rig is a drill ship and the combination of landing string and casing string are configured so that at least a majority of the,combined overall length of the landing string and casing string spans the distance between the drill ship and the undersea well location at the seabed during use.

22. The drilling rig, pipe, and pipe support apparatus of claim 21 wherein the combined weight of landing string and casing string is between about 950,000 and 2,300,000 pounds.

23. The drilling rig, pipe, and pipe support apparatus of claim 17 wherein the wedge members do not have teeth that bite into and deform the surface of the drill pipe.

24. The drilling rig, pipe, and pipe support apparatus of claim 17 wherein the holder has a tapered bowl that receives the wedge members and each of the wedge member has an interior surface with a curved surface that engages a correspondingly shaped curved shoulder on the drill pipe at a position spaced away from the box or pin end of the drill pipe.

25. The drilling rig, pipe, and pipe support apparatus of claim 17 wherein the holder includes a main body, and a plurality of wedge members that form an interface between the body and the uppermost joint of drill pipe, each wedge member having a curved, tapered shoulder, the tapered shoulders of the wedge members engaging the tapered annular shoulder of the supported drill pipe.

26. The drilling rig, pipe, and pipe support apparatus of claim 25 wherein the pipe has a weight of between 29 and 110 pounds per foot.

27. The drilling rig, pipe, and pipe support apparatus of claim 25 further comprising a casing string supported by the landing string.

28. The drilling rig, pipe, and pipe support apparatus of claim 25 wherein the drilling rig is a drill ship and the combination of landing string and casing string are configured so that at least a majority of the combined overall length of the landing string and casing string spans the distance between the drill ship and the undersea well location at the seabed during use.

29. The drilling rig, pipe, and pipe support apparatus of claim 25 wherein the combined weight of landing string and casing string is between about 950,000 and 2,300,000 pounds.

30. The drilling rig, pipe, and pipe support apparatus of claim 25 wherein the wedge members do not have teeth that bite into and deform the surface of the drill pipe.

31. The drilling rig, pipe, and pipe support apparatus of claim 25 wherein the holder has a tapered bowl that receives the wedge members and each of the wedge members has an interior surface with a curved surface that engages a correspondingly shaped curved shoulder on the drill pipe at a position spaced away from the box or pin end of the drill pipe.

32. The drilling rig, pipe, and pipe support apparatus of claim 25 wherein the enlarged diameter section is spaced between about one and three feet from one of the pin or box end portions.

33. The drilling rig, pipe, and pipe support apparatus of claim 17 wherein the enlarged diameter section is spaced between about one and three feet from one of the pin or box end portions.

34. The drilling rig, pipe, and pipe support apparatus of claim 33 wherein at least one of the one end portions and the annular enlarged diameter section have correspondingly shaped annular tapered shoulders.

35. The drilling rig, pipe, and pipe support apparatus of claim 17 wherein at least one of the pin or box end portions and the annular enlarged diameter section have correspondingly shaped annular tapered shoulders.

36. The drilling rig, pipe, and pipe support apparatus of claim 17 wherein each joint of pipe has a pipe outside diameter of between about 4½ and 7⅝ inches.

37. The drilling rig, pipe, and pipe support apparatus of claim 17 wherein the tapered shoulders form an angle of between about 10 and 45 degrees with the central longitudinal axis of its pipe joint.

38. A pipe and pipe support apparatus comprising:

a) a landing string comprised of a number of joints of pipe connected end to end that generate a huge tensile load, each joint of pipe having enlarged diameter pin and box end portions and an enlarged diameter section spaced in between the pill and box end portions, but closer to the box end portion;

b) a pipe holder that supports the landing string at the enlarged diameter section during the addition or removal of a joint of pipe to or from the landing string;

c) wherein the holder and an uppermost joint of pipe that is supported by the holder are configured to support the tensile load of the landing string with correspondingly shaped tapered annular shoulders that engage when the holder supports the uppermost joint of pipe; and d) the holder including a main body, and a plurality of wedge members that form an interface between the body and the uppermost joint of pipe.

39. A pipe and pipe support apparatus comprising:

a) a landing string comprised of a number of joints of pipe connected end to end that generate a huge tensile load, wherein a number of joints of the pipe in the landing string have an enlarged diameter section and wherein the enlarged diameter section is spaced apart from the ends or the pipe, but closer to one end than the other;

b) a pipe holder that supports the enlarged diameter section of pipe in the landing string during the addition or removal of a joint of pipe to or from the landing string;

c) wherein the holder and the joint of pipe that is held by the holder are configured to support the tensile load of the landing string with correspondingly shaped annular shoulders that engage when the holder holds the joint of pipe;

d) the holder including a main body and a plurality of wedge members, the wedge member forming an interface between the body and the joint of pipe being held by the holder.

* * * * *